US007328897B2

(12) United States Patent
Bryant et al.

(10) Patent No.: US 7,328,897 B2
(45) Date of Patent: Feb. 12, 2008

(54) CARD PRINTER AND METHOD OF PRINTING ON CARDS

(75) Inventors: Caleb J. Bryant, Moorpark, CA (US); Phil S. Bryer, Tarzana, CA (US); Daniel E. Perry, Camarillo, CA (US); Alexander Peter, Van Nuys, CA (US); Lionel C. Chavarria, Moorpark, CA (US)

(73) Assignee: ZIH Corp., Hamilton (BM)

( * ) Notice: Subject to any disclaimer, the term of this patent is extended or adjusted under 35 U.S.C. 154(b) by 475 days.

(21) Appl. No.: 10/852,769

(22) Filed: May 21, 2004

(65) Prior Publication Data

US 2005/0082738 A1 Apr. 21, 2005

Related U.S. Application Data

(63) Continuation-in-part of application No. 10/690,395, filed on Oct. 20, 2003, now abandoned.

(60) Provisional application No. 60/536,621, filed on Jan. 14, 2004.

(51) Int. Cl.
*B65H 5/00* (2006.01)

(52) U.S. Cl. ..... 271/225; 271/185; 271/149; 235/475

(58) Field of Classification Search ..... 271/3.19, 271/145, 184, 185, 186, 225, 10.01, 149, 271/9.01, 187; 347/107, 104; 221/263; 235/475, 480

See application file for complete search history.

(56) References Cited

U.S. PATENT DOCUMENTS 4,519,600 A 5/1985 Warwick et al.

(Continued)

FOREIGN PATENT DOCUMENTS

EP 0 622 242 A 11/1994

(Continued)

OTHER PUBLICATIONS

International Search Report, Feb. 16, 2005.

(Continued)

*Primary Examiner*—Patrick Mackey
*Assistant Examiner*—Michael C McCullough
(74) *Attorney, Agent, or Firm*—Alston & Bird LLP

(57) ABSTRACT

A compact system adapted for card imaging, card laminating, or other card processing, comprises a card processor positioned on a horizontal card feed path and configured to process one or both faces of a rectangular card such as a plastic credit or debit card. A card feeder is arranged to feed cards one at a time onto the horizontal feed path upstream of the card processor, the feeder comprising a compartment for holding a stack of vertical cards each supported on a long edge and a card feed mechanism configured to successively draw a card from an end of the stack and translate it off the stack. A card re-director is configured to receive the card and to redirect it to an attitude in which it is parallel with the horizontal card feed path and positioned to be fed to the card processor along the horizontal feed path. The compartment is located above the horizontal card feed path, and the card feeder feeds cards substantially vertically downward into the card re-director. The card processor may comprise a card printer and a magnetic strip encoder. Also disclosed are methods of printing, encoding and feeding cards.

36 Claims, 25 Drawing Sheets

U.S. PATENT DOCUMENTS 5,326,179 A 7/1994 Fukai et al.
5,401,111 A 3/1995 Nubson et al.
5,503,382 A * 4/1996 Hansen et al. ..... 271/3.03
5,529,411 A 6/1996 Nakata et al.
5,667,316 A 9/1997 Nardone et al.
5,769,407 A * 6/1998 Hansen ..... 271/3.03
5,806,843 A * 9/1998 Hansen et al. ..... 271/3.03
5,825,392 A 10/1998 Mochizuki
5,836,580 A * 11/1998 Hansen et al. ..... 271/9.13
5,871,209 A * 2/1999 Orchard et al. ..... 271/149
5,959,278 A * 9/1999 Kobayashi et al. ..... 235/449
5,962,832 A * 10/1999 Dorner ..... 235/380
6,236,420 B1 * 5/2001 Matsuzaka ..... 347/170
6,285,845 B1 9/2001 Liatard et al.
6,408,151 B1 6/2002 Heno
6,554,512 B2 4/2003 Heno et al.
6,567,112 B2 * 5/2003 Suzuki ..... 347/217
6,582,141 B2 6/2003 Meier et al.
6,587,135 B1 7/2003 Suzuki et al.
6,722,649 B2 * 4/2004 Yui ..... 271/184
7,198,262 B2 * 4/2007 Hartl et al. ..... 271/2
2001/0052923 A1 * 12/2001 Suzuki ..... 347/217
2002/0106229 A1 8/2002 Meier et al.
2002/0145245 A1 * 10/2002 Casto et al. ..... 271/10.01
2002/0195765 A1 * 12/2002 Tunink et al. ..... 271/9.01

FOREIGN PATENT DOCUMENTS

WO WO 02/32200 A 4/2002

OTHER PUBLICATIONS

Partial International Search Report, dated Aug. 27, 2005.
European Search Report for EP 06006810.3, completed on Jul. 12, 2006.
Complete European Search Report for EP 06125566.7, dated May 31, 2007.
Partial European Search Report for EP 06125566.7, completed on Feb. 5, 2007.

* cited by examiner

FIG. 6
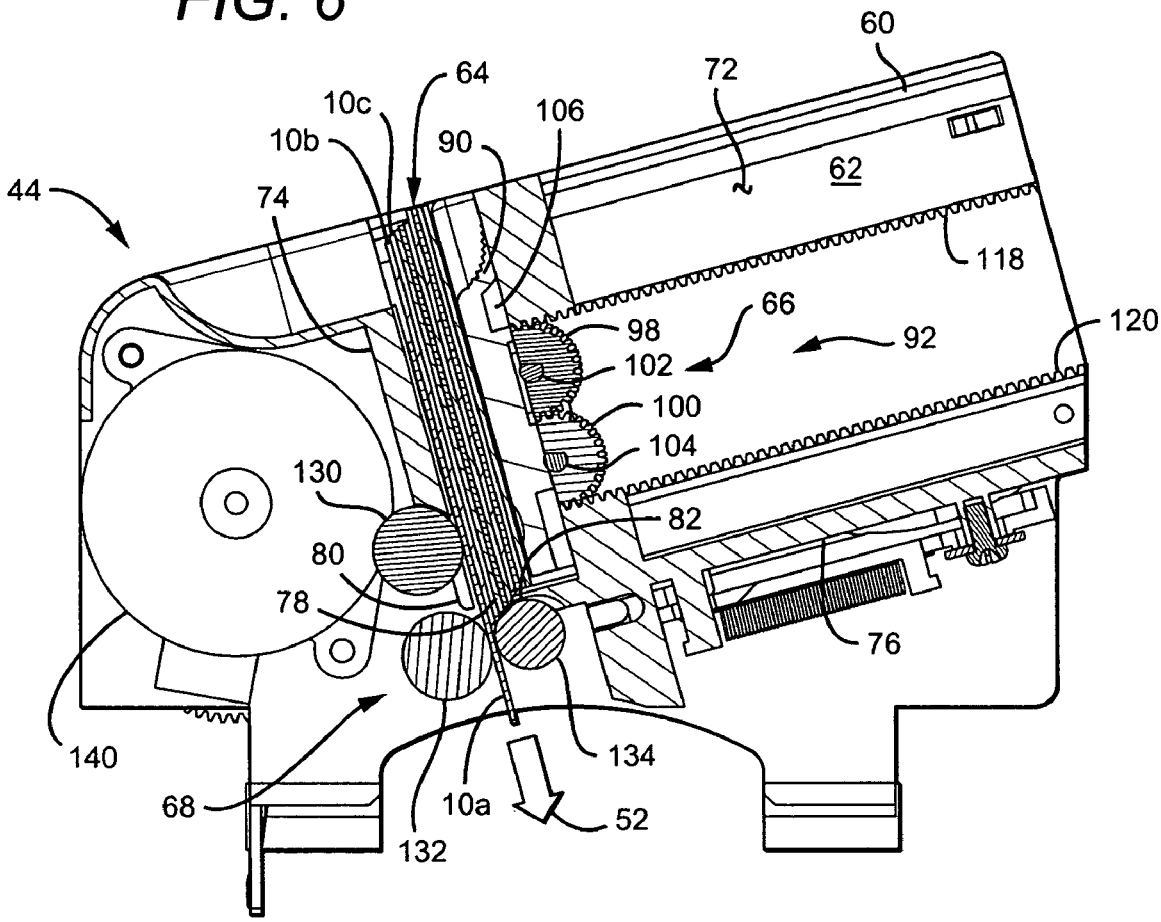
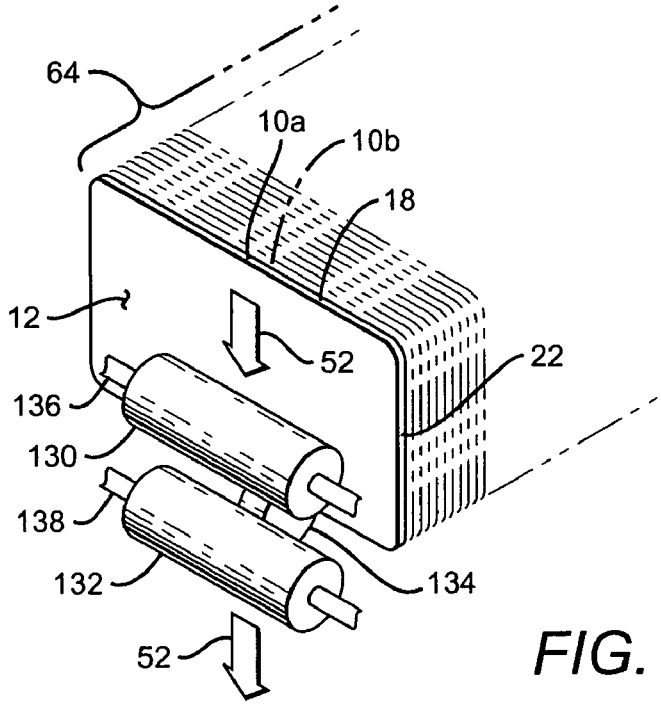
FIG. 7

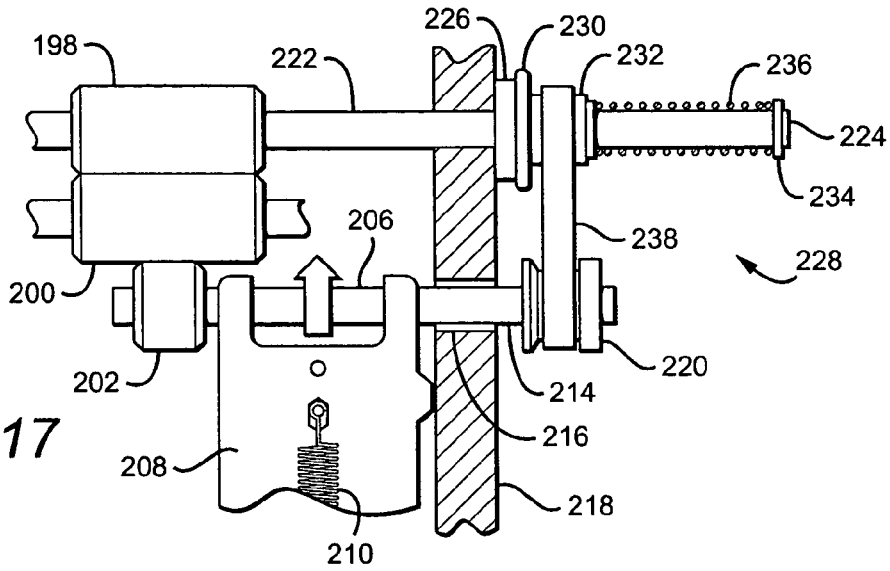
FIG. 17
FIG. 18
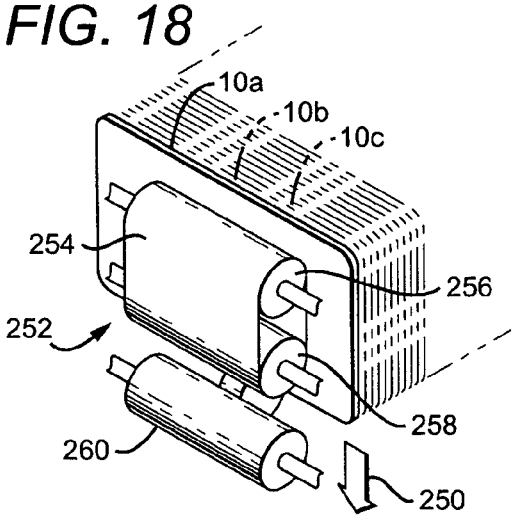
FIG. 19
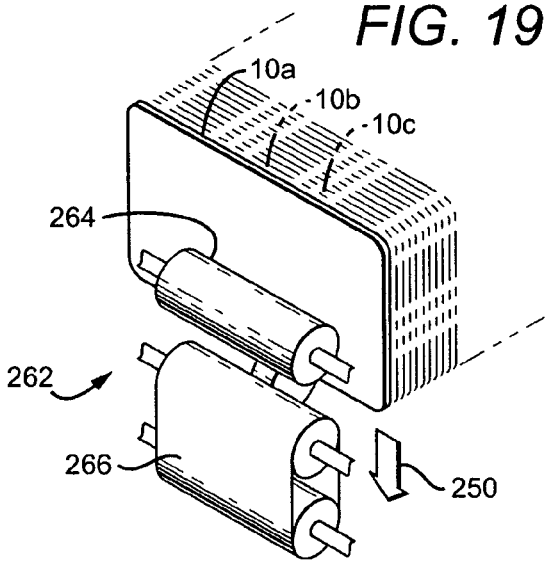
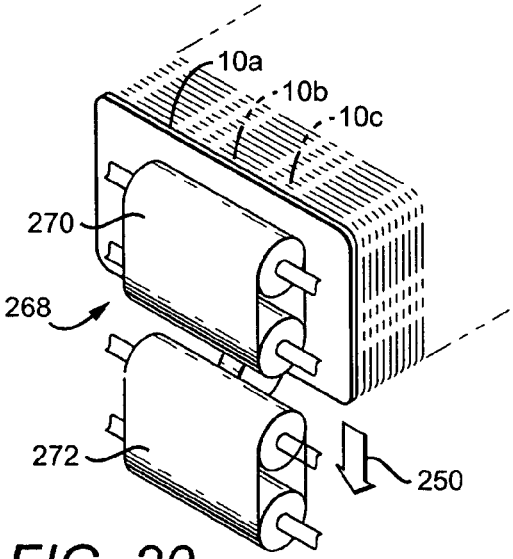
FIG. 20
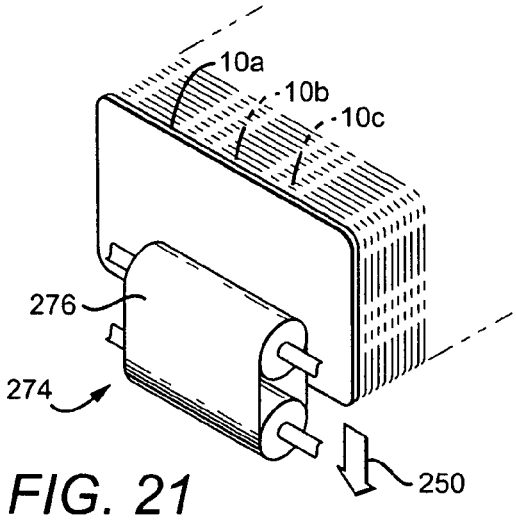
FIG. 21

FIG. 27
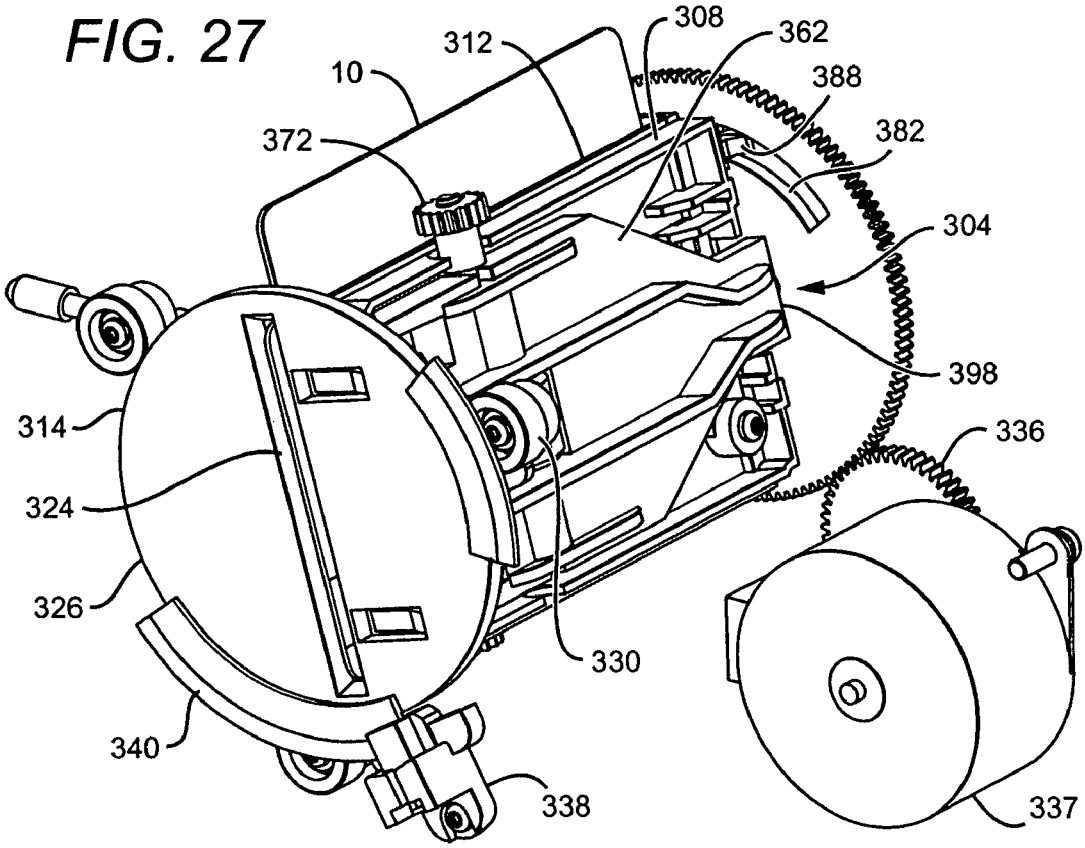
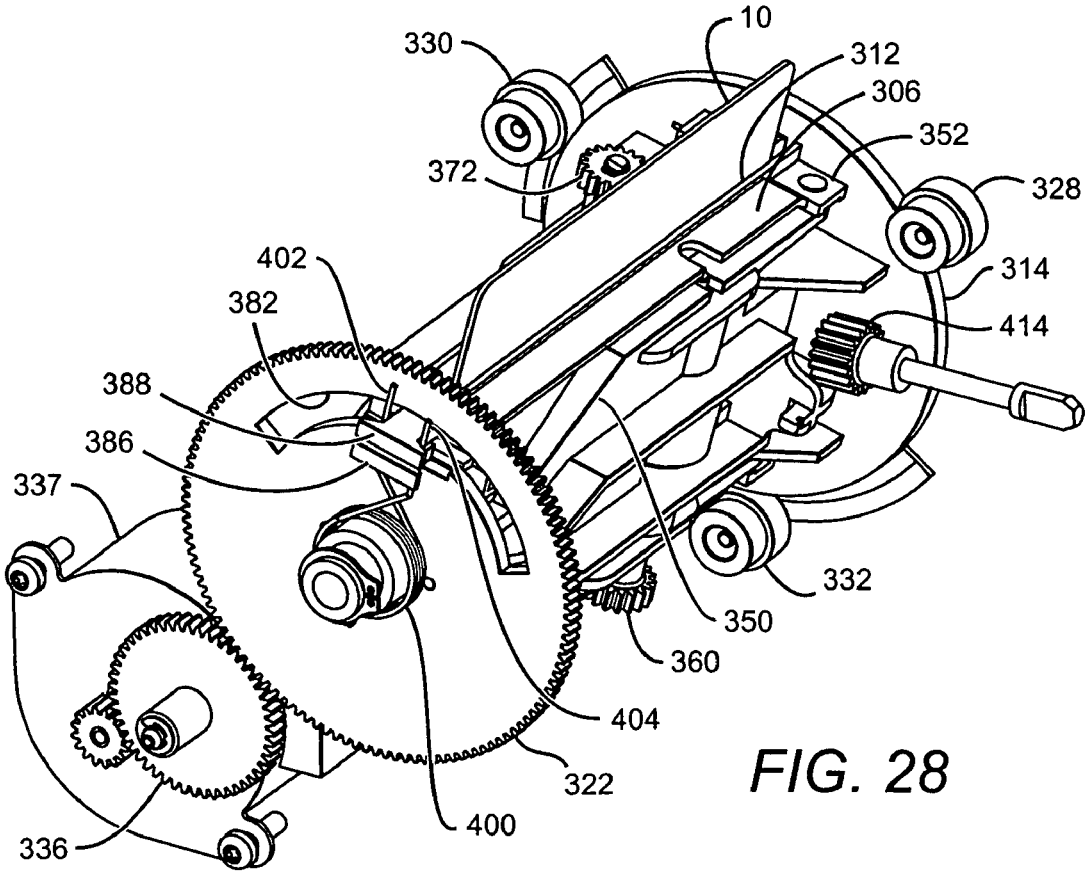
FIG. 28

FIG. 31
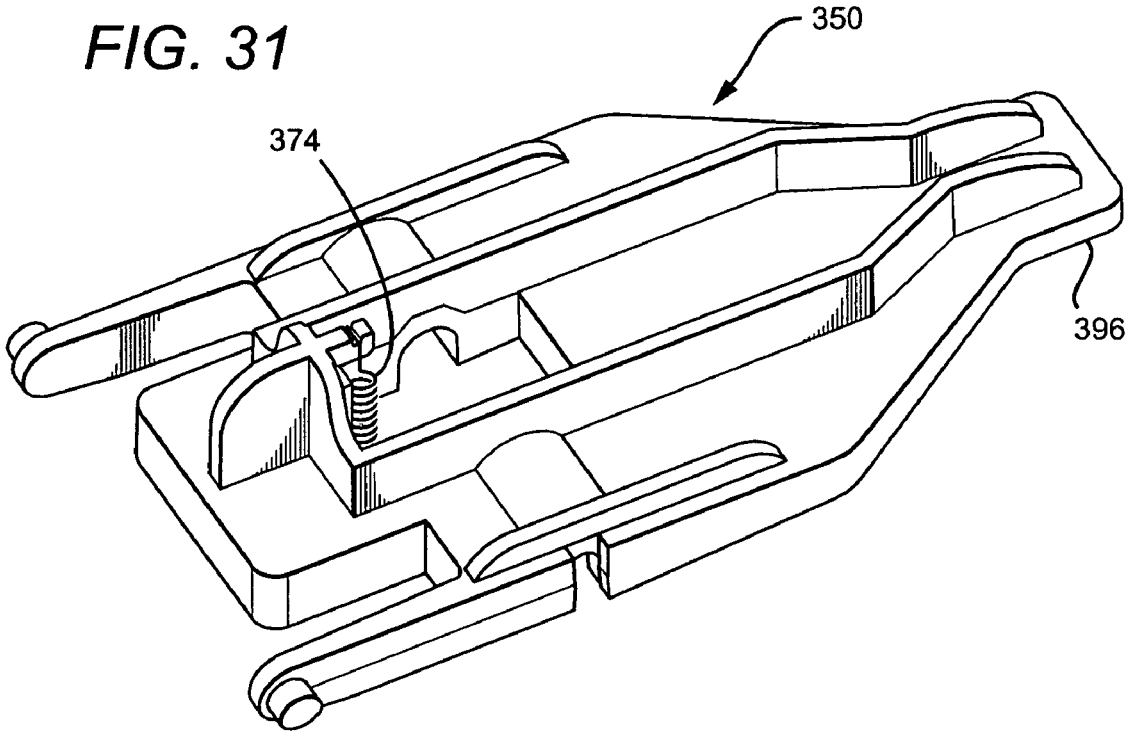
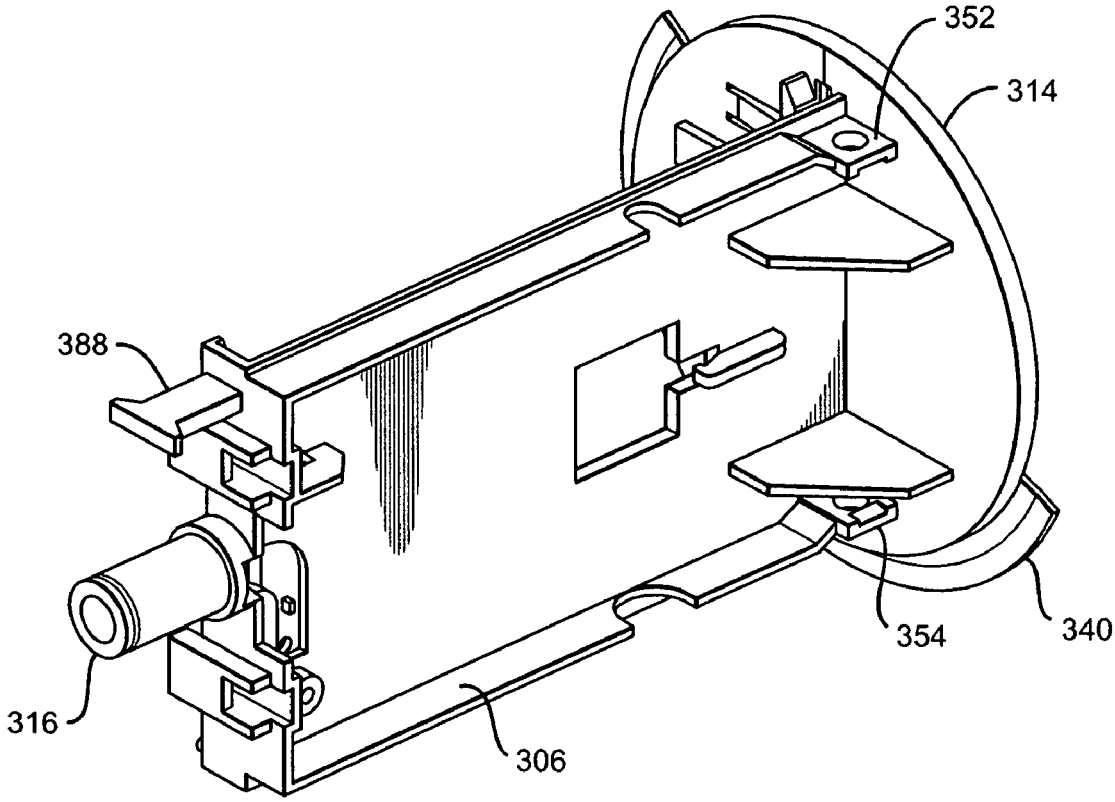
FIG. 32

FIG. 33
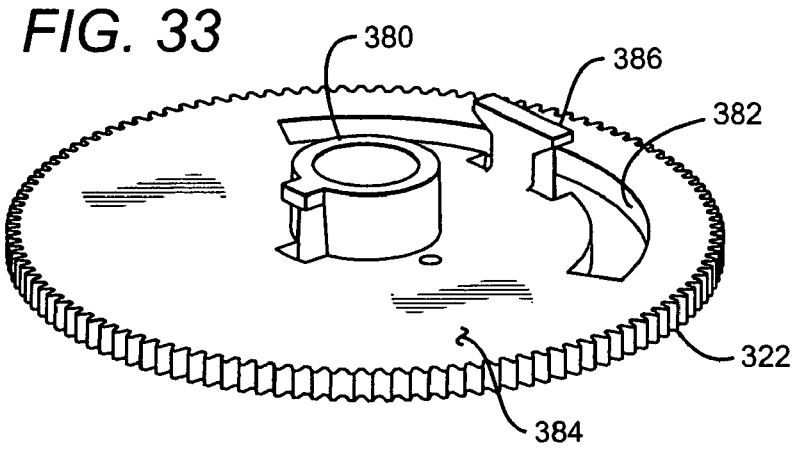
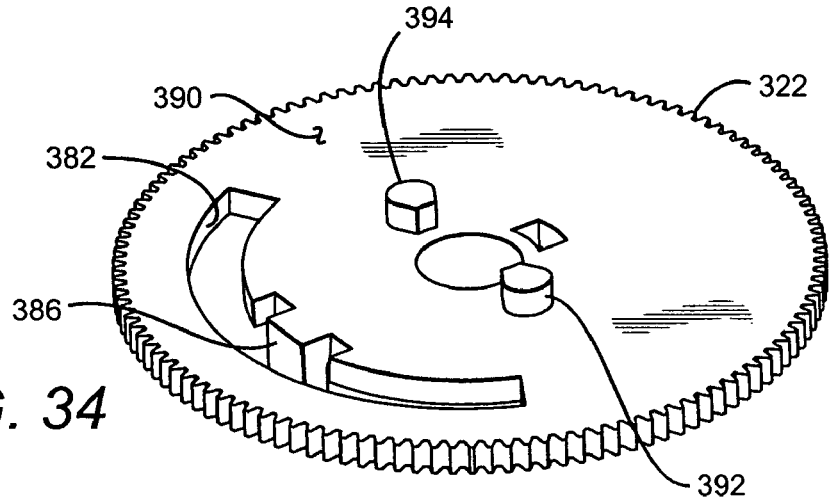
FIG. 34
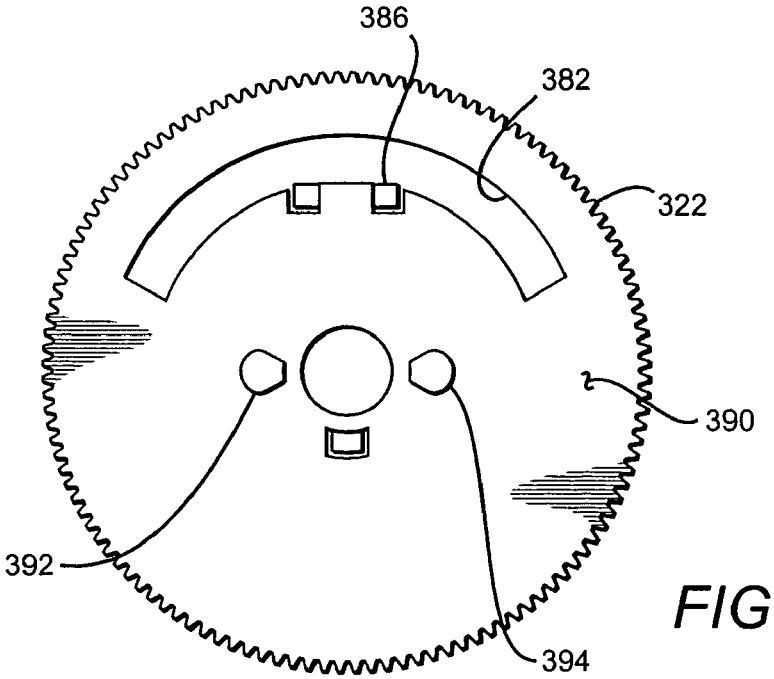
FIG. 35

FIG. 36
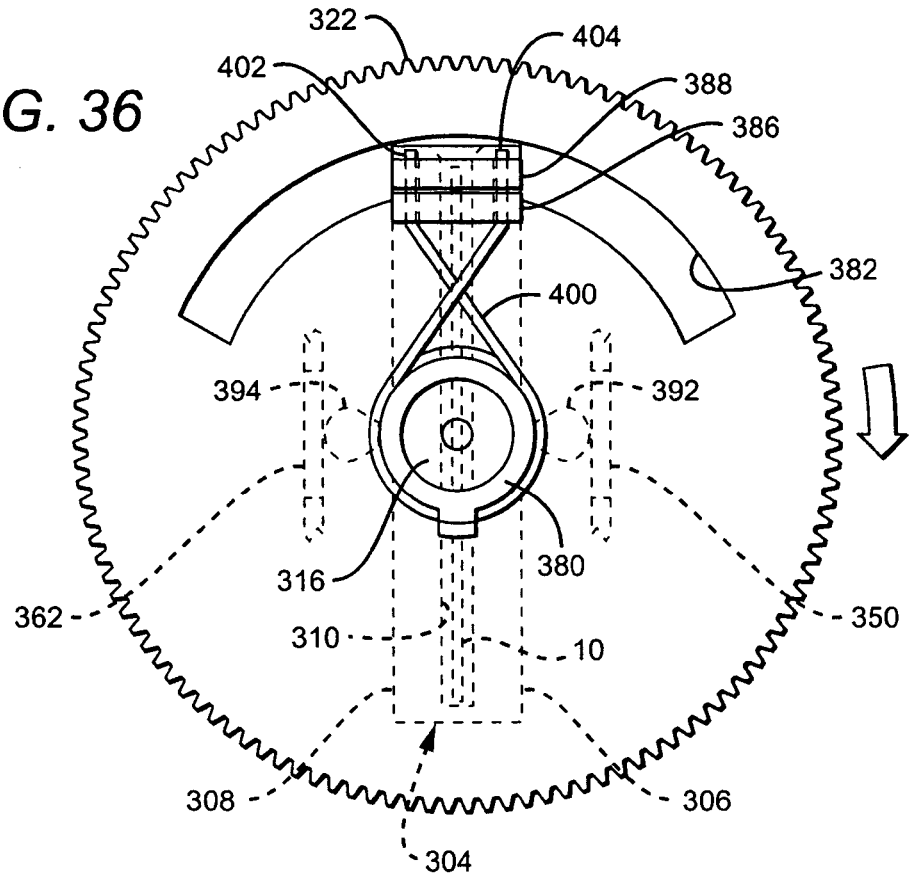
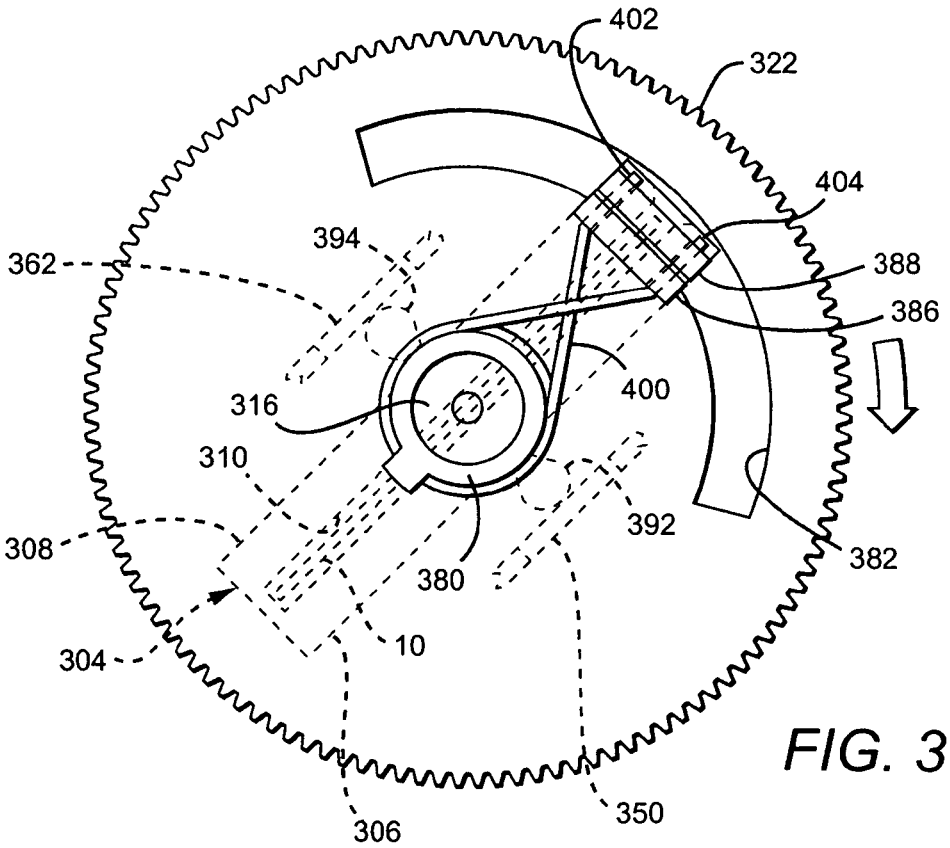
FIG. 37

FIG. 38
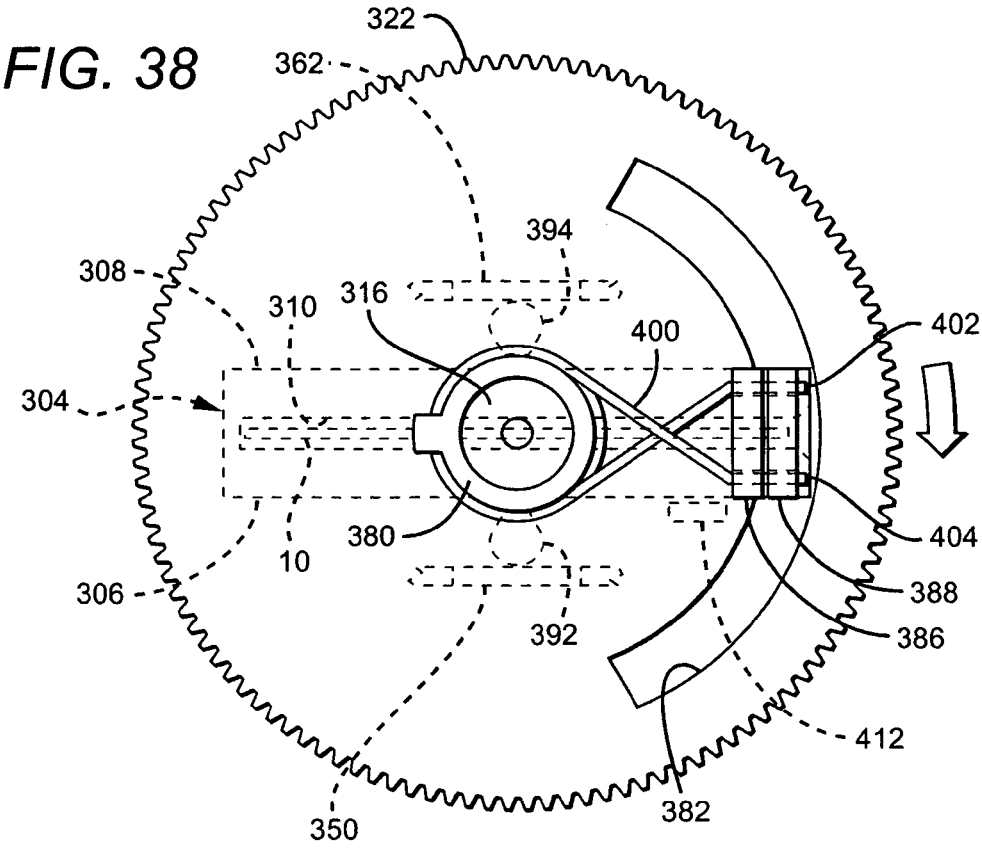
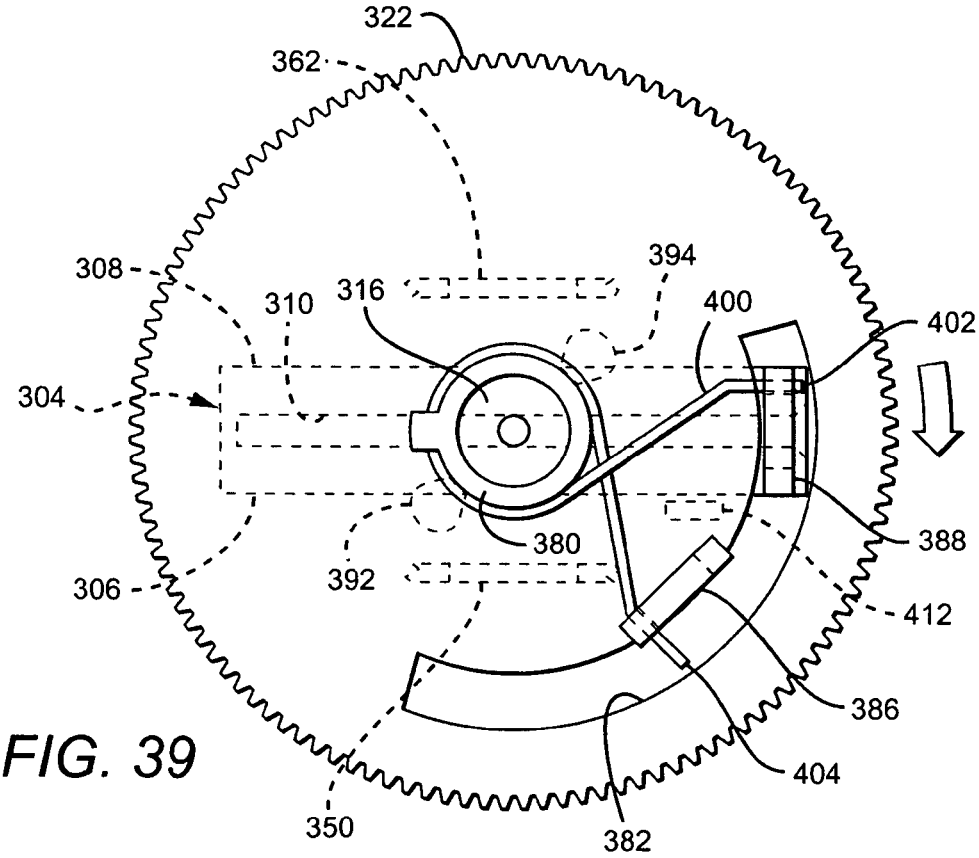
FIG. 39

FIG. 40
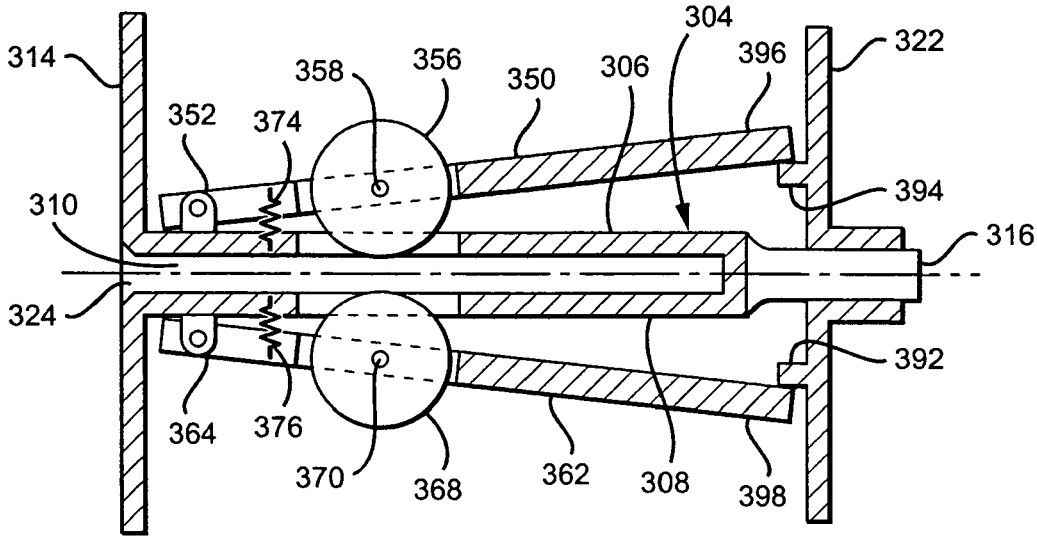
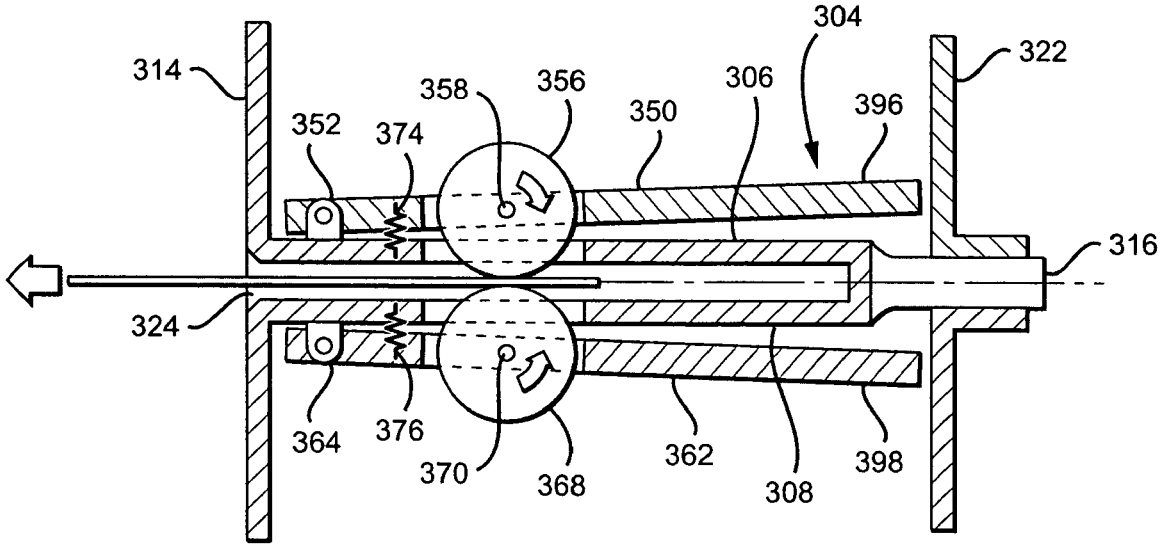
FIG. 41

CARD PRINTER AND METHOD OF PRINTING ON CARDS

CROSS REFERENCES TO RELATED APPLICATIONS

This application is a continuation-in-part of U.S. nonprovisional patent application Ser. No. 10/690,395 filed Oct. 20, 2003, now abandoned for "Substrate Cleaning Apparatus and Method". This application further claims priority from U.S. provisional application No. 60/536,621 filed Jan. 14, 2004 for "Card Printer and Method of Printing on Cards".

FIELD OF THE INVENTION

The present invention relates generally to card printers for applying information in the form of images, text and the like on one or both of the faces of cards, and particularly to a card printer that is compact both vertically and horizontally. The invention further relates to a method of printing on cards. Still further, the invention relates to the feeding of cards in succession from a stack of cards and particularly to a card feed apparatus and method for feeding cards of various thicknesses while inhibiting the feeding of more than one card at a time from the card stack.

BACKGROUND OF THE INVENTION

Various kinds of cards are becoming more prevalent for such purposes as security (for example, identification cards and badges), financial transactions (credit and debit cards), driver's licenses, and so forth. These cards are typically made of plastic but may also comprise paper or cardboard. The cards may have printed or embossed characters, magnetic strips, and/or other images or indicia on one or both faces. Although the length and width of these cards have been substantially standardized, card thicknesses may vary considerably.

FIG. 1 shows a plastic card 10 typical of those in use today. The card 10 has a front face 12, a rear face 14 carrying a longitudinally-extending magnetic strip 16, and a generally rectangular geometry comprising a pair of opposed, parallel, longitudinally-extending long edges 18 and 20 and a pair of opposed, parallel, transversely-extending short edges 22 and 24. The card 10 has a longitudinal or major central axis 26 and a transverse or minor central axis 28.

Conventional printers for printing information on discrete cards such as that shown in FIG. 1 comprise a linear series of processing stations or modules generally including a card feeder, a card flipper or inverter, a print mechanism and a card discharge station. A typical card feeder has a vertical hopper designed to receive a supply of horizontally oriented cards stacked one on top of another. A lifter under the stack urges the stack upwardly to progressively raise the stack as cards are successively withdrawn from the top. The card feeder supplies the cards to the card inverter that rotates each card as necessary and transfers it to and from the card print mechanism in a sequence of steps whereby one or both faces of the card are printed. In conventional printers, the card inverter rotates the card about its shorter or minor central axis 28 (FIG. 1). The print mechanism typically comprises a thermal printhead cooperating with a thermal transfer ribbon or dye sublimation ribbon to print information on a face of each card as the card is fed lengthwise past the print mechanism.

The present invention addresses several drawbacks of conventional card printers. For example, because the various stations or modules of conventional card printers are arranged in a row, such printers take up considerable desktop space. Moreover, because the cards are stored as a vertical stack in the card supply hopper, conventional card printers tend to be tall. Contributing to their height (as well as to their length) are the card inverters or flippers that rotate the cards around their minor axes. Besides using space inefficiently, existing card printers, because of their size, cost more to manufacture requiring, for example, larger, more expensive enclosures.

In addition, most conventional card feeders have a fixed slot or gate at the discharge of the card supply hopper through which the cards are passed out of the hopper. The width of the gate is usually set to accommodate one particular card thickness and must be manually readjusted to accept cards having other thicknesses. This is undesirable because it is difficult to measure and to set a gate to accurately feed cards of widely varying thicknesses without double feeding. Double feeding occurs when the card being fed from the top of a stack of cards drags the next card below along with it.

BRIEF DESCRIPTION OF THE DRAWINGS

Various objects, features and advantages of the present invention will become evident to those skilled in the art from the detailed description below when taken together with the accompanying drawings in which:

FIG. 6 is a side elevation view, in cross section, of a card feeder forming part of the printer of FIGS. 3-5;

FIG. 7 is a simplified perspective view of a portion of the card feeder of FIG. 6;

FIG. 17 is a bottom plan view, partly in cross section, of a portion of the card feeder shown in FIG. 16;

FIGS. 18-21 are simplified perspective views of portions of card feeders in accordance with further, alternative embodiments of the invention;

FIG. 27 is a perspective view of the card rotator without its frame;

FIG. 28 is another perspective view of the card rotator without its frame;

FIG. 31 is a perspective view of a pivotable feed roller support forming part of the card rotator;

FIG. 32 is a perspective view of a portion of a card throat-defining structure forming part of the card rotator of the invention;

FIG. 33 is a perspective view of the card rotator drive gear showing details of the outer surface thereof;

FIG. 34 is a perspective view of the card rotator drive gear showing details of the inner surface thereof;

FIG. 35 is an end elevation view of the card rotator drive gear showing the inner surface thereof;

FIGS. 36-39 are end elevation views of a portion of the card rotator illustrating the operation thereof;

FIG. 40 is a schematic, top plan view, partly in cross-section of a portion of the card rotator in which the card rotator feed rollers are moved apart to allow a card to enter the card throat of the rotator;

FIG. 41 is a schematic, side elevation view, partly in cross-section of the card rotator in which the feed rollers are in a position to engage and discharge a card from the card rotator.

DETAILED DESCRIPTION OF THE INVENTION

The following description is of a best mode presently contemplated for practicing the invention. This description is not to be taken in a limiting sense but is made merely for the purpose of describing the general principles of the invention whose scope may be ascertained by referring to the appended claims. For example, the present invention is described below in terms of processing of "cards" in terms of printing, encoding, laminating cards. It must be noted that the present invention is applicable for use in any system where are card is feed to the system from a stack of cards, regardless of what the system does with the card after it has been received. For example, the present invention may be used to supply cards to a device that further mills the card, such as by shaping the card, punching or drilling holes in the card, etc.

Further, it must be understood that the term "card" as used herein should not be limiting. A card, as used herein, refers to any unit of media that is fed from a stack through a path to a system. The card may be paper, plastic, metal, etc. It also may have any desired shape, such as rectangular, square, circular, triangular, etc.

Figure 2:
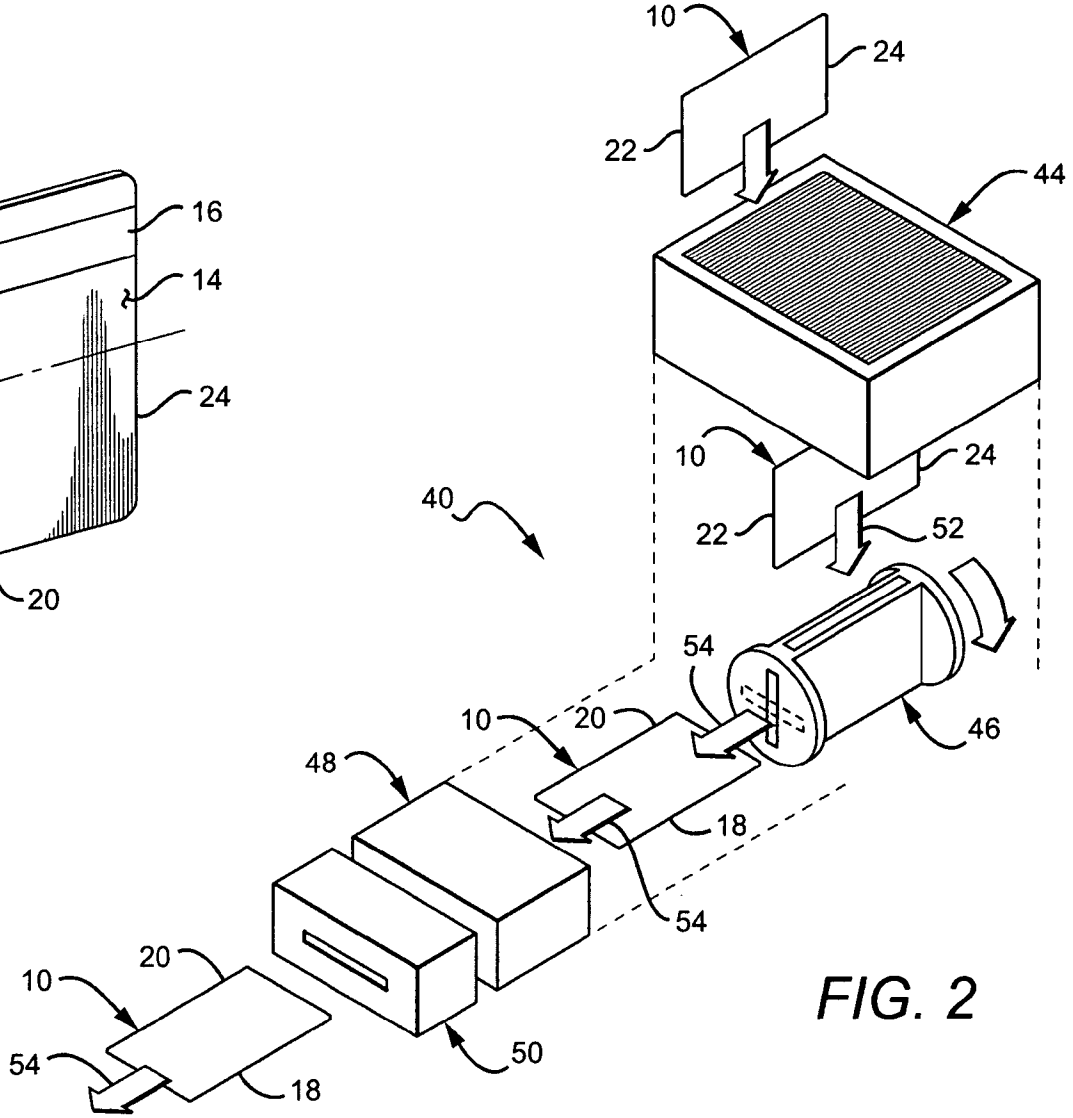
FIG. 2 is an exploded, perspective view of a printer in accordance with the invention showing, in simplified form, the overall organization of the principal components of the printer.
Figure 1:
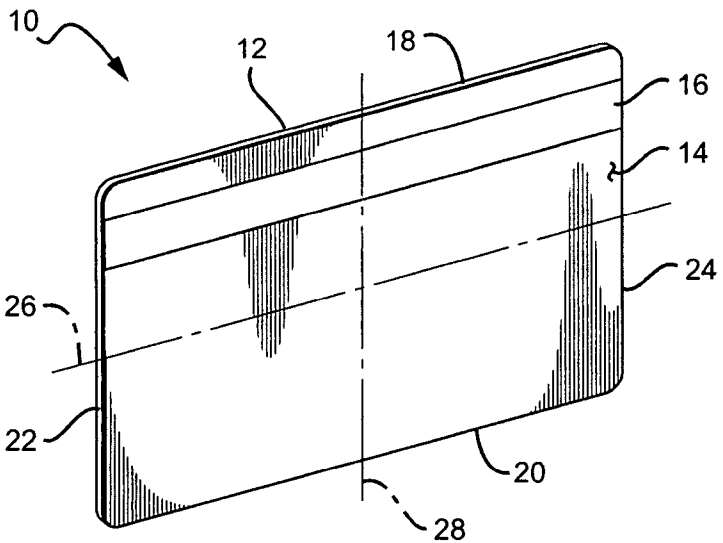
FIG. 1 PRIOR ART
FIG. 1 is a perspective view of a standard plastic card one or both of the faces of which may be printed or otherwise imaged using the printer and method of the present invention.
Figure 3:
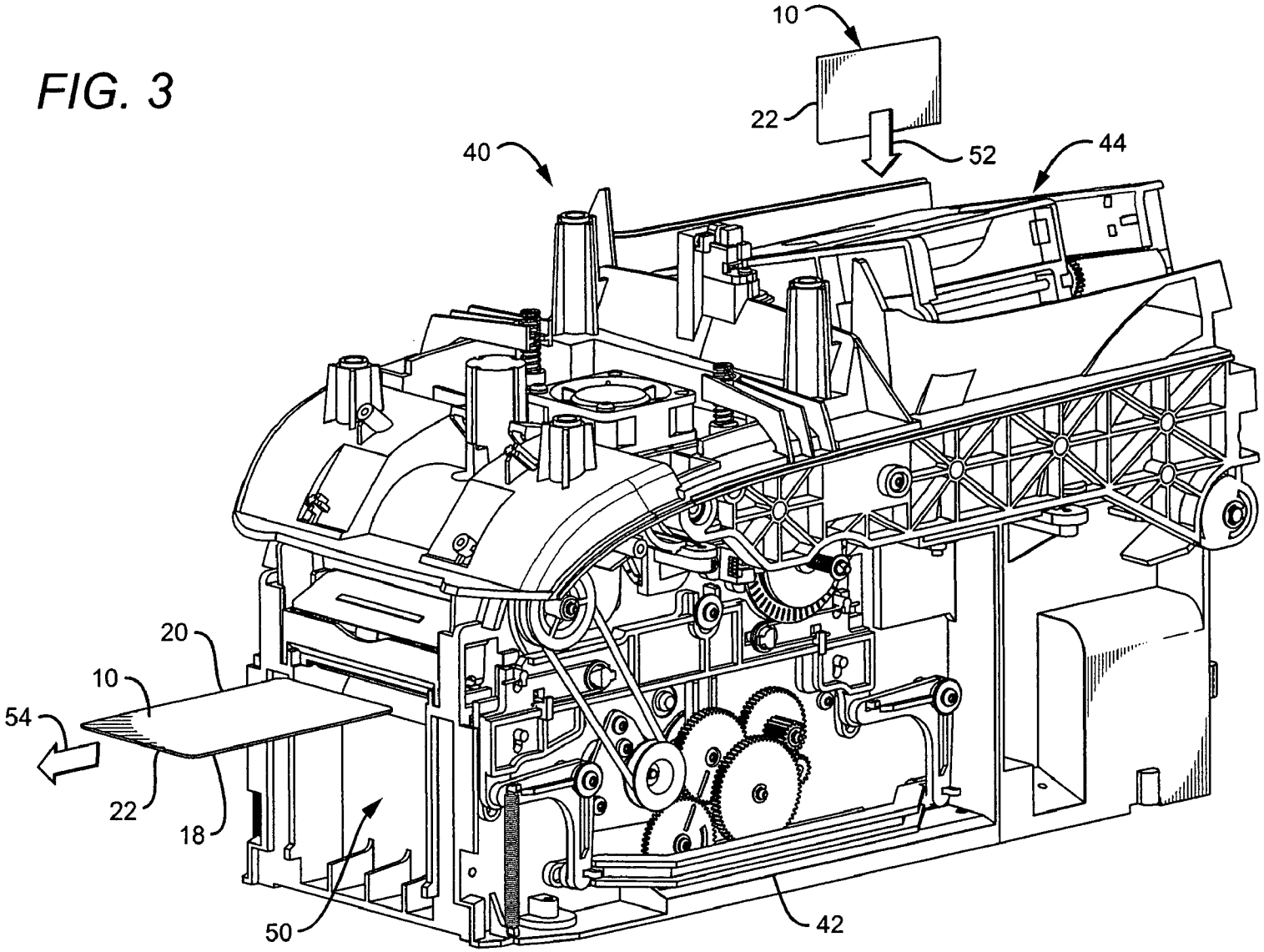
FIG. 3 is a front perspective view of a printer incorporating a specific, exemplary embodiment of the present invention.
Figure 4:
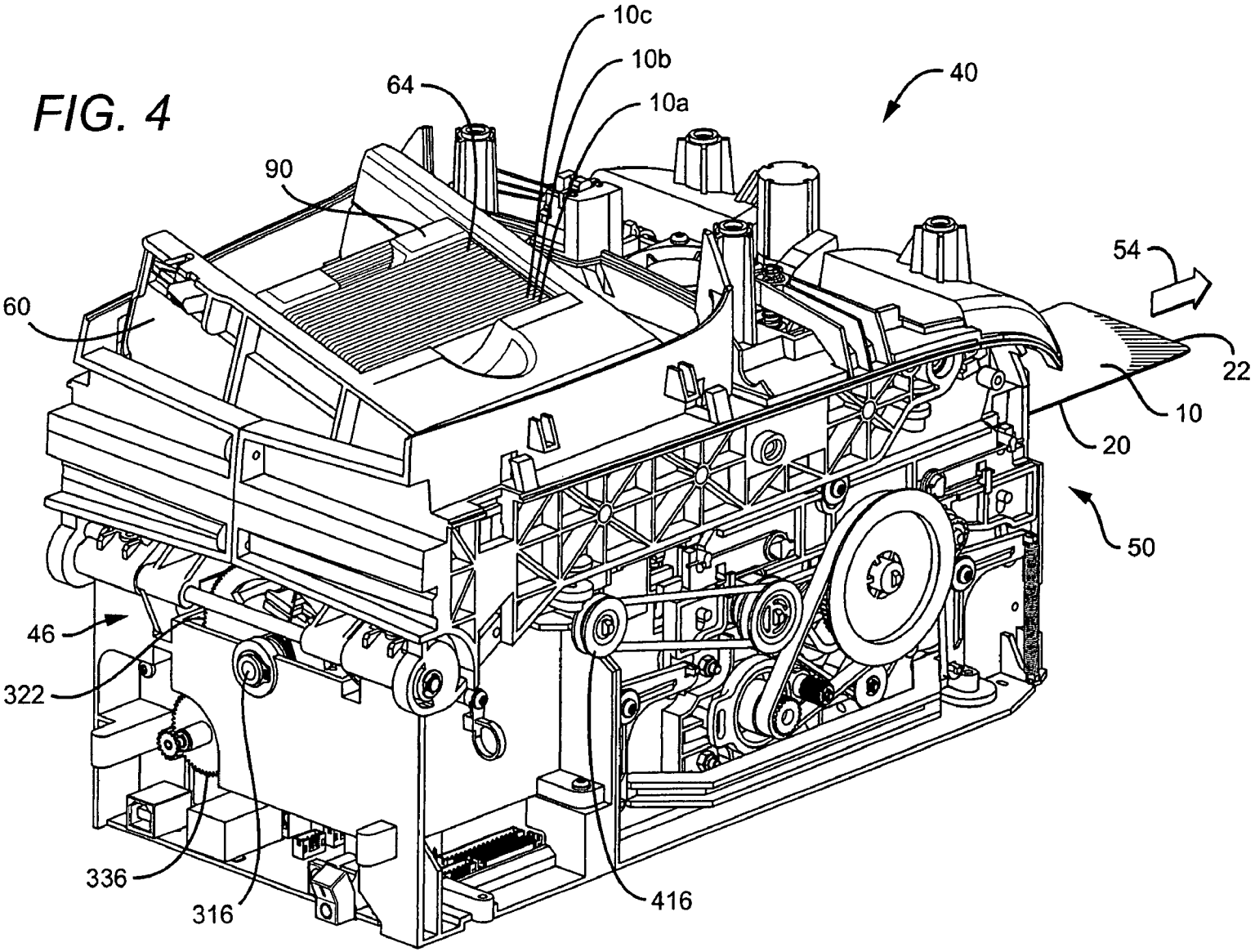
FIG. 4 is a rear perspective view of the printer shown in FIG. 3.
Figure 5:
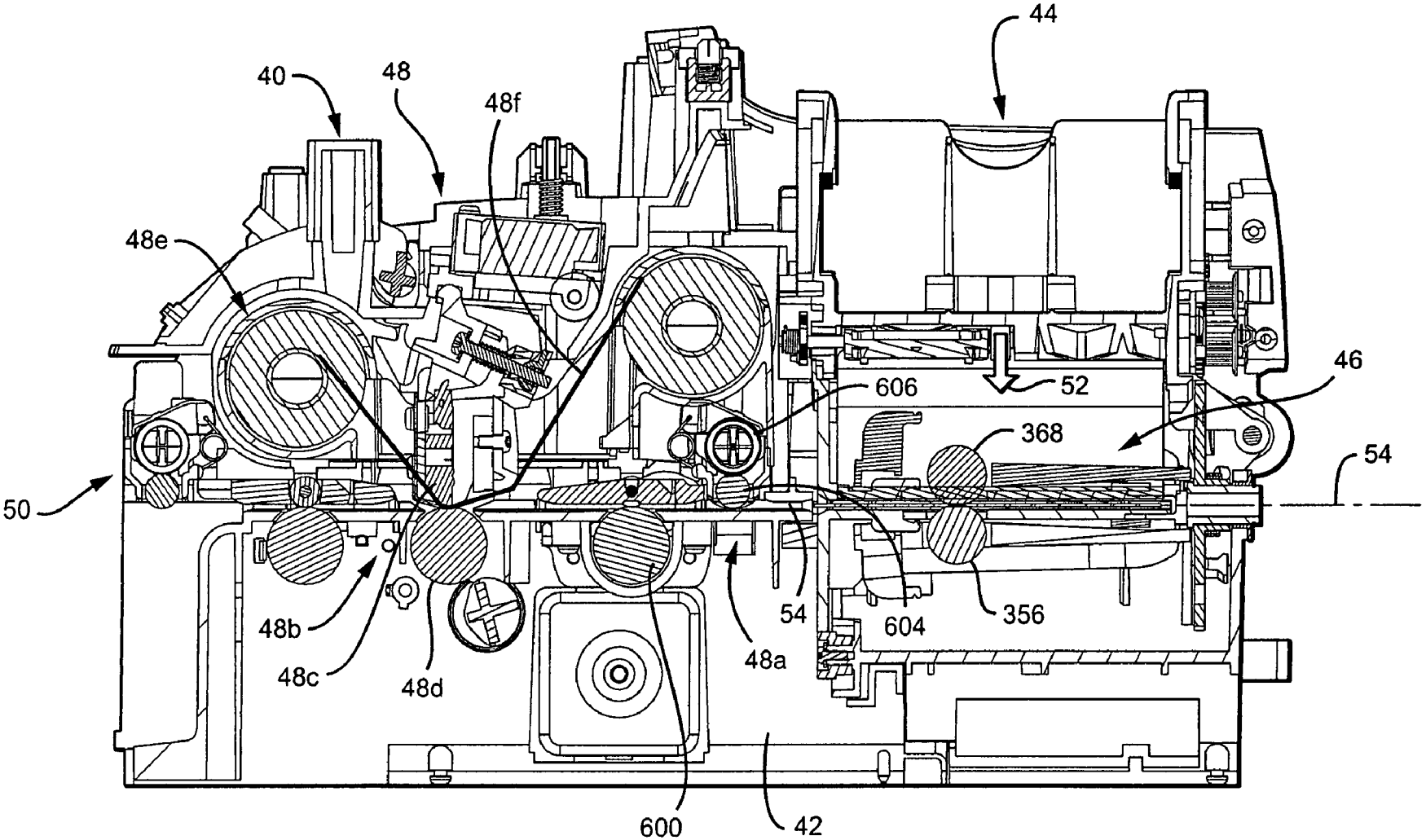
FIG. 5 is a side elevation view, in cross section, of the printer shown in FIGS. 3 and 4.

FIG. 2 shows in block diagram form and FIGS. 3-5 show in greater detail, a specific, exemplary embodiment of a card processing system 40 in accordance with the present invention. The system 40 comprises a card printer for printing on cards 10 such as that shown in FIG. 1. By way of example, the card printer 40 may comprise a thermal transfer card printer of the kind typically used to print information in the form of text, graphics, photographs, and so forth, on plastic cards such as I.D. cards, driver's licenses, and the like, using a thermal printhead cooperating with a thermal transfer or dye sublimation ribbon carried by a disposable ribbon cartridge.

The card printer 40 generally comprises a printer body or frame 42 supporting a card feeder 44; a card re-director or rotator 46; a card processor 48 comprising a card cleaning station 48*a*, a card print mechanism 48*b* including a thermal printhead 48*c*, a printing platen roller 48*d* and a removable, replaceable cartridge 48*e* containing a printer consumable comprising a transfer medium typically in the form of a thermal transfer or dye sublimation ribbon 48*f*; and a card discharge station 50.

In accordance with one aspect of the present invention, the card feeder 44 is positioned above the card rotator 46. The card rotator 46 receives cards 10 in succession from the card feeder 44 along a first feed path 52, rotates each card about its long axis 26 and redirects it to move along a second feed path 54 between the card rotator 46 and the print mechanism 48 (FIGS. 2, 3 and 5). The cards 10 are transported along the first feed path 52 with their short edges 22 and 24 parallel with the path 52 and along the second feed path 54 with their long edges 18 and 20 parallel with the path 54. In the specific, exemplary embodiment shown, the first feed path 52 extends in a generally vertical direction while the second feed path 54, along which the card processor or print mechanism 48 is located, extends in a generally horizontal direction. As will be explained in greater detail below, cards supplied by the card feeder 44 are rotated through approximately 90° by the card rotator 46 before being transported to the print mechanism 48 for printing on one of the card faces. So processed, the card may then be advanced to the discharge station 50. Alternatively, in a double-pass printing mode, the card 10 may be returned to the rotator 46 for inversion and delivery back to the print mechanism 48 for printing on the other face of the card followed by discharge of the card from the printer.

Card Feeder

With reference now also to FIGS. 6-14, there is shown one, specific exemplary embodiment of the card feeder 44. The card feeder 44 includes a card feeder body 60 defining a card supply compartment 62 for holding a card stack 64 comprising a plurality of cards 10*a*, 10*b*, 10*c*, and so forth, to be processed. The compartment 62 contains means 66 for biasing the card stack 64 toward a card feed mechanism 68 that removes the cards 10*a*, et seq., in succession from the card supply compartment 62 and prevents or inhibits the removal of more than one card at a time from the stack. The card feed mechanism 68 operates independently of card thickness, the feed mechanism being thus capable of feeding cards of different thicknesses without adjustment.

The card supply compartment 62 has a generally rectangular configuration and is defined by opposed, parallel side walls 70 and 72, a fixed front end wall 74 and a bottom wall 76 of the feeder body 60. The card supply compartment 62 is open at the top for receiving a supply of cards to be fed through a front, transverse, slot-like discharge opening 78 (FIGS. 6, 10 and 14) of fixed size defined by a lower edge 80 of the front wall 74 and a front edge 82 of the bottom wall 76. The cards are advanced in succession through the opening 78 by means of the card feed mechanism 68 in a generally downward direction (as indicated by the arrow) along the generally vertical, first feed path 52, toward the rotator 46.

The cards 10*a*, et seq., placed in the card supply compartment 62 are preferably oriented as best seen in FIGS. 6 and 7. More specifically, the cards are preferably stacked with the short edges 22 and 24 extending generally vertically, that is, parallel with the first feed path 52. Alternatively, the card supply compartment 62 may be configured to receive a stack of cards having their long edges 18 and 20 extending vertically; however, stacking the cards as preferred, with their short edges upright, substantially reduces the overall height of the printer.

A pusher plate 90, as seen, for example, in FIGS. 4, 6, 8 and 11, is mounted for longitudinal translation within the card supply compartment 62 and urges the card stack 64 toward the fixed front end wall 74. The movable pusher plate 90 is resiliently biased toward the front wall 74 and forms the rear wall of the supply compartment. The pusher plate 90 applies to the rear of the card stack 64 a force that remains substantially constant during depletion of the stack as the cards 10*a*, et seq., are withdrawn therefrom.

Figure 8:
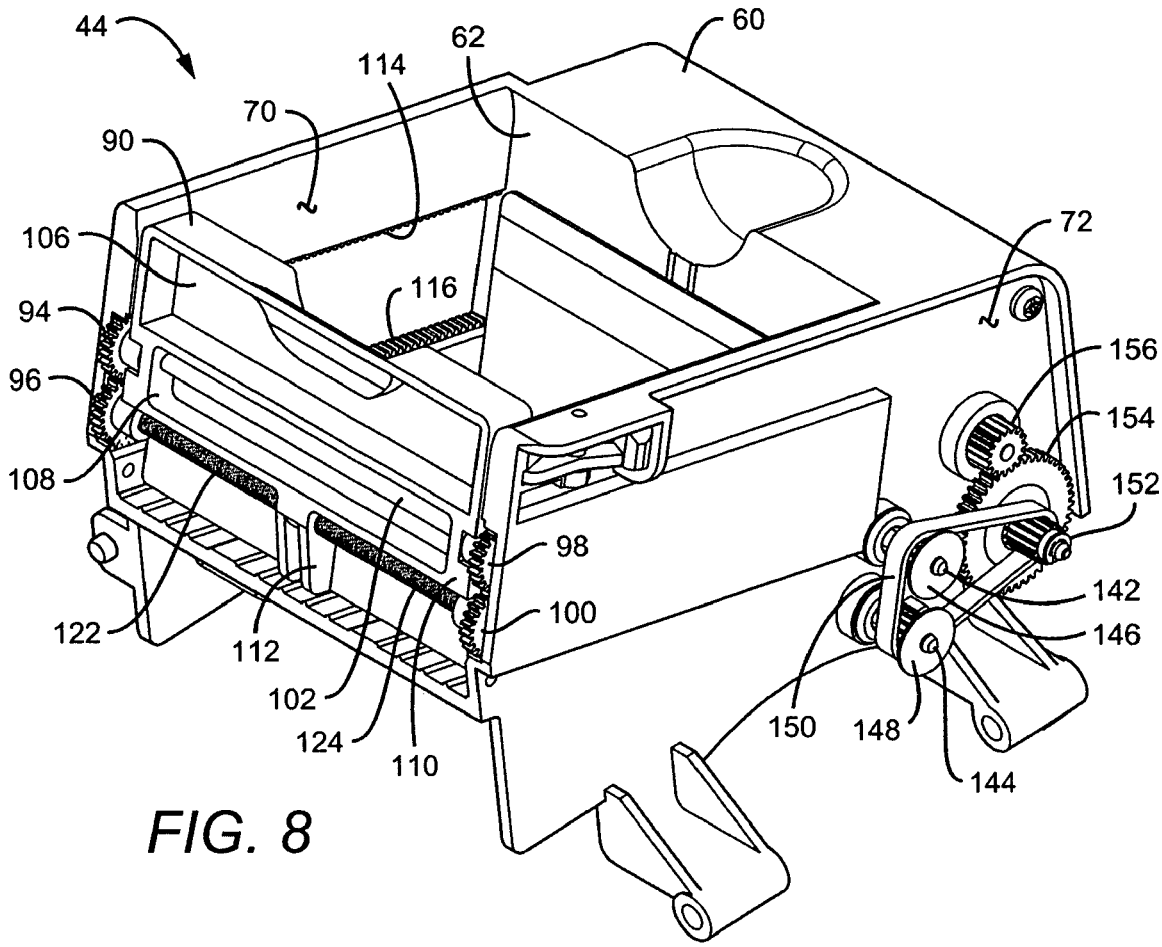
FIG. 8 is a perspective view of the card feeder showing details of a feed roller drive and a card stack pusher plate mechanism.
Figure 9:
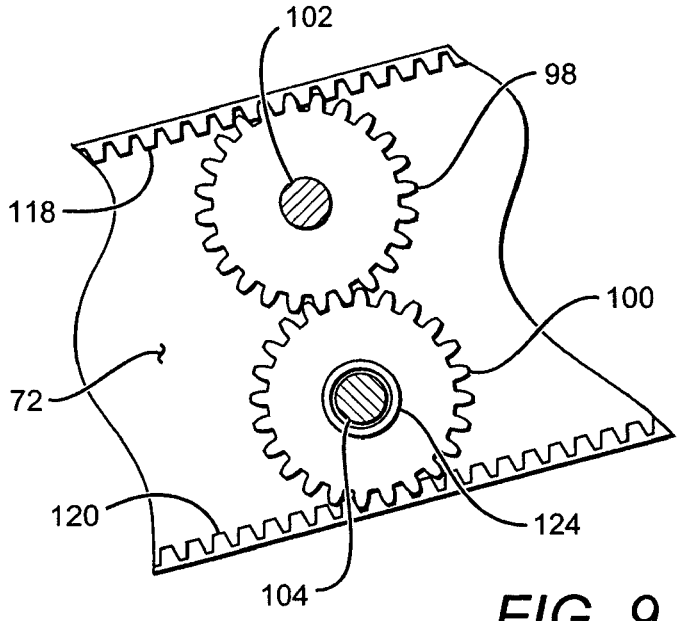
FIG. 9 is a side elevation view, in cross section, of a portion of the card feeder showing details of the mechanism for controlling the motion of the pusher plate.

The pusher plate 90 is mounted for smooth, stable, jam-free translation within the compartment 62 by means of a spring-loaded mechanism 92 seen in FIGS. 6, 8 and 9. The mechanism 92 comprises two pairs of meshed pinions 94, 96 and 98, 100 secured to the ends of a pair of parallel, upper and lower transverse shafts 102 and 104 mounted on a rear surface 106 of the pusher plate 90. More specifically, the upper transverse shaft 102 is journaled for rotation in vertical legs 108 and 110 defined by the pusher plate 90 at opposite ends thereof. The lower transverse shaft 104 is journaled for rotation in a central bearing block 112 on the rear surface 106 of the pusher plate 90. The pinions 94 and 96 mesh with spaced-apart, parallel, horizontal racks 114 and 116 mounted on or made integral with the side wall 70 of the feeder body. Similarly, the pinions 98 and 100 mesh with spaced-apart, parallel, horizontal racks 118 and 120 on the side wall 72. A pair of torsion springs 122 and 124 wound about the shaft 104 and anchored at their inner ends to the central bearing block 112 and at their outer ends to the respective pinions 96 and 100, provide the resilient bias that urges the pusher plate 90 against the rear of the card stack. In this connection, the torsion springs 122 and 124 are preloaded, that is, they are wound and mounted so as to be under an initial torsional load. As the pusher plate 90 is manually retracted by the user, the torsion springs 122 and 124 are further wound, the energy so stored being released when the pusher plate 90 advances as the cards in the card stack 64 are withdrawn from the card supply compartment. The torsion springs 122 and 124 are closely wound and have numerous turns (that is, substantial effective lengths) so that as they unwind when the pusher plate 90 moves forward, the force exerted by the springs remains substantially constant. It will be seen that the mechanism 92 constrains the pusher plate 90 to remain upright as the plate is translated in either direction within the compartment.

The card feed mechanism 68 includes friction drive surfaces, preferably in the form of three rollers 130, 132 and 134 at the front of the card supply compartment 62. The roller 130 comprises a first or primary feed roller that is mounted on a transverse shaft 136 journaled for rotation in the side walls 70 and 72 of the card feeder body at a fixed position above the bottom wall 76. The first feed roller 130 is centered transversely and its drive surface projects slightly into the card supply compartment 62 so that the leading or first card 10*a* (FIGS. 6, 7, and 14) in a stack of cards loaded into the compartment frictionally engages the first feed roller 130 in response to the resilient bias exerted by the pusher plate 90. The roller 132 comprises a secondary feed roller that is mounted on a transverse shaft 138 journaled for rotation in the side walls 70 and 72 at a fixed position below the bottom wall 76 of the card supply compartment. It will be seen in FIGS. 6 and 14 that a line of tangency contacting the primary and secondary rollers 130 and 132 is parallel with the inner surface of the fixed front end wall 74 of the card supply compartment. Both the primary and secondary rollers 130 and 132 are rotatable in unison by a stepper motor 140 secured to the inner surface of the side wall 72 so as to advance a card 10*a*, etc., along the feed path 52. In this connection, with reference also to FIG. 8, the primary and secondary roller shafts 136 and 138 have outer ends 142 and 144, respectively, projecting from the side wall 72 of the card feeder body 60. The outer ends 142, 144 of the shafts 136, 138 carry sprockets 146 and 148, respectively. Trained about the sprockets 146 and 148 is a toothed timing belt 150 driven by an idler sprocket 152 attached to an idler gear 154 in turn driven by a pinion 156 mounted on the output shaft of the stepper motor 140.

Figure 10:
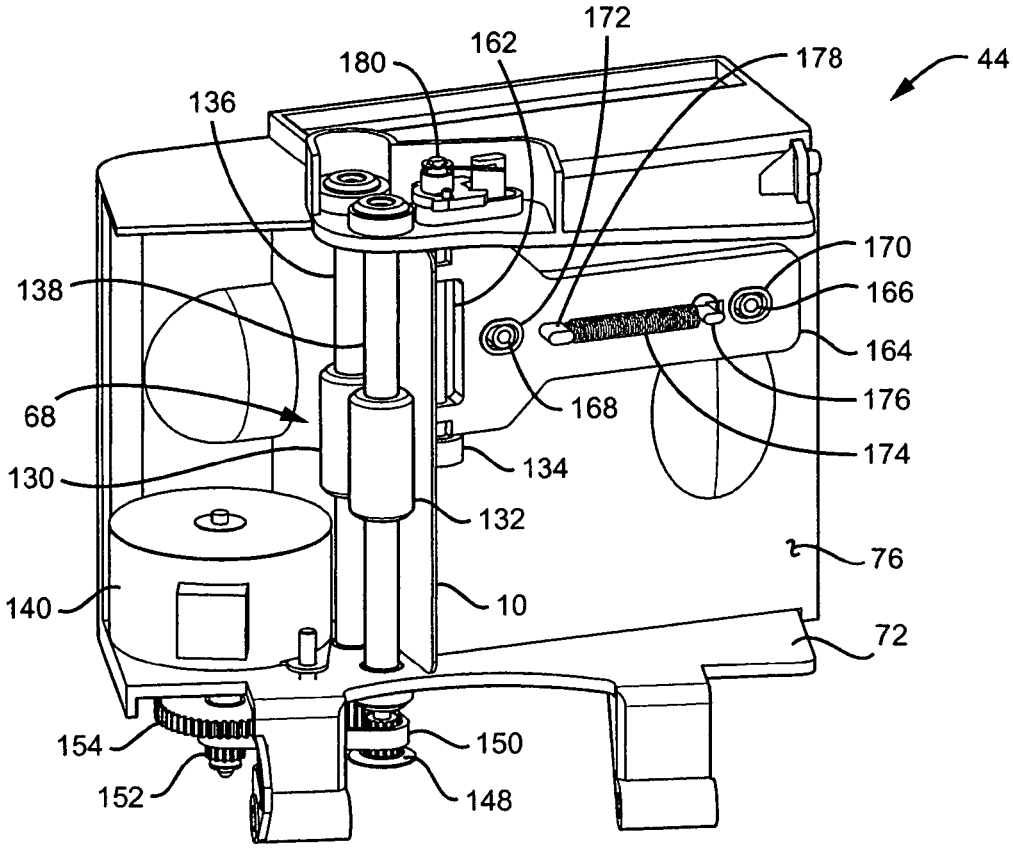
FIG. 10 is a bottom perspective view of the card feeder.
Figure 11:
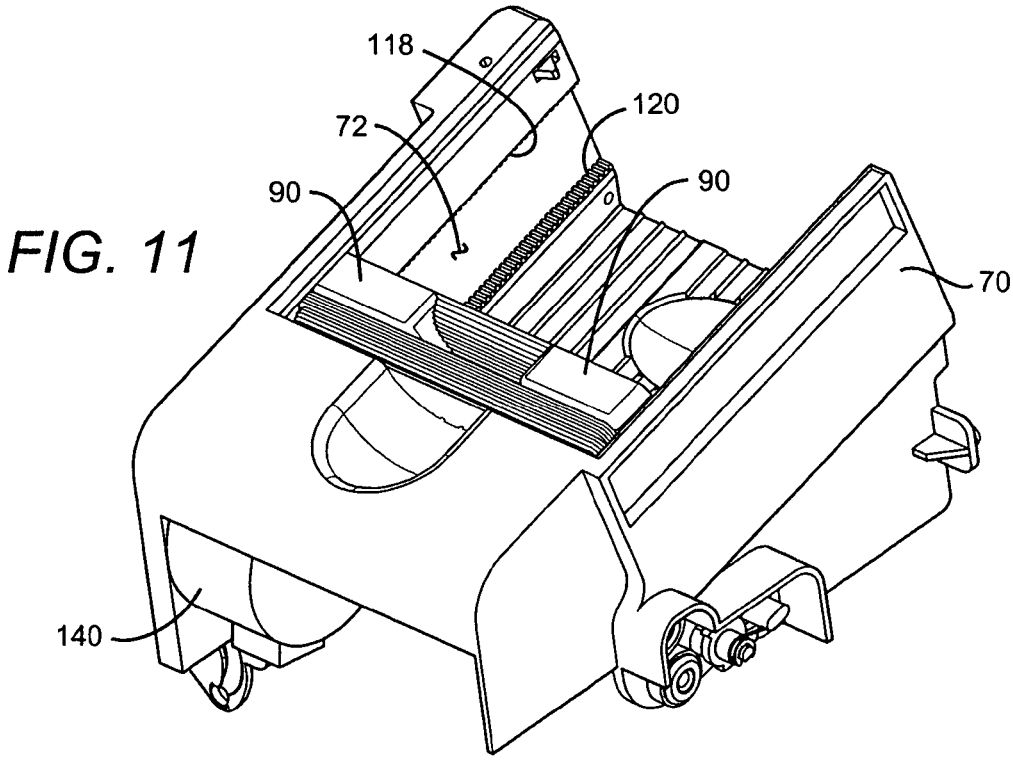
FIG. 11 is a top perspective view of the card feeder.
Figure 12:
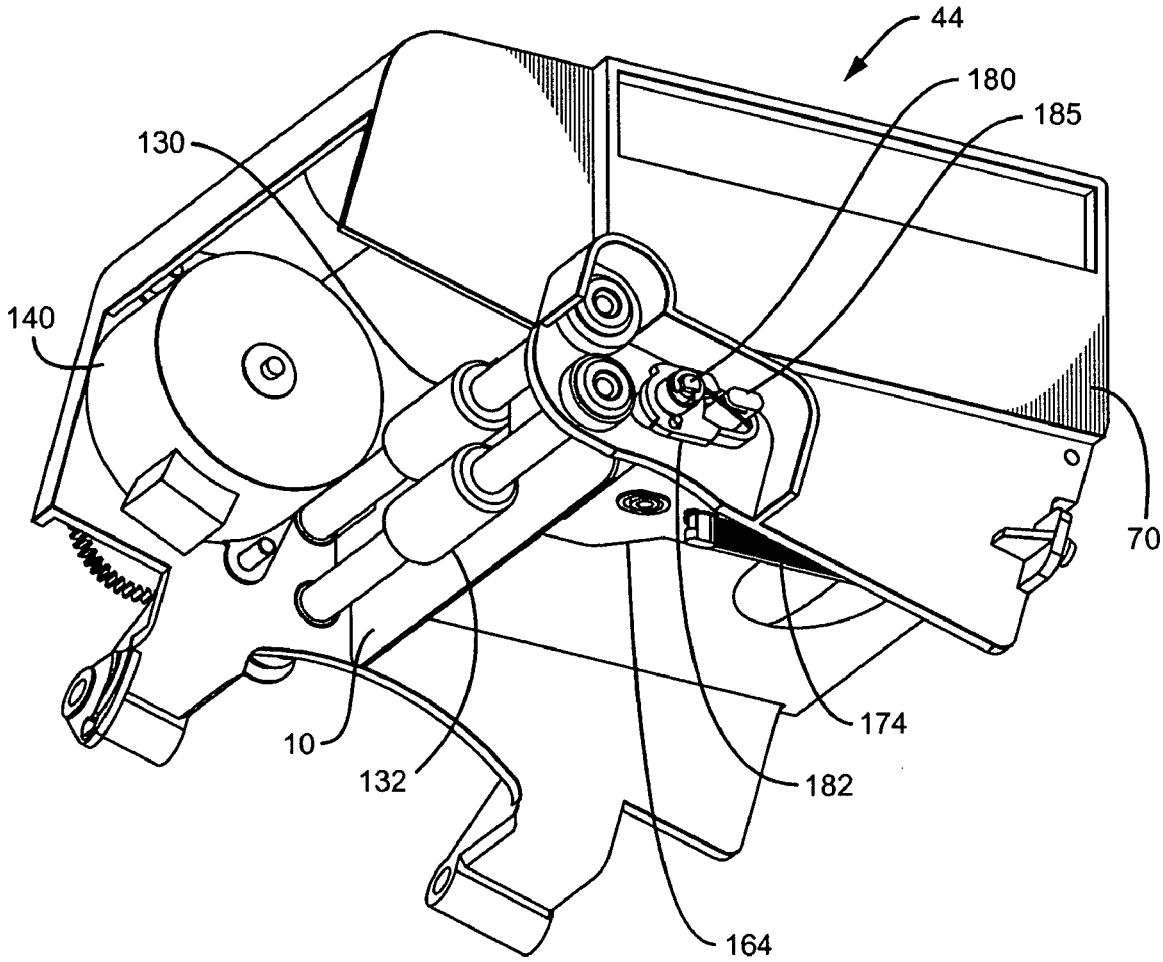
FIG. 12 is a another bottom perspective view of the card feeder.

As best seen in FIGS. 7 and 10, the primary and secondary rollers 130 and 132 have the same lengths. The roller 134 comprises a third or tertiary roller that functions in counteracting fashion to return toward the card stack a second card improperly withdrawn from the card stack along with a correctly fed first card. The tertiary roller 134 is substantially narrower than the primary and secondary rollers 130 and 132 and is mounted on the side opposite the feed path 52 from the primary and secondary rollers and in alignment with and centered on the secondary roller 132.

The tertiary roller 134 is mounted on the inner end of a shaft 162 supported by a floating plate 164 in turn carried by a pair of fixed guide pins 166 and 168 projecting from the lower surface of the bottom wall 76 and extending through oversize slots 170 and 172 in the plate 164. A tension spring 174 anchored between a post 176 near the rear of the plate 164 and a fixed post 178 projecting from the bottom wall resiliently biases the plate 164 to urge the tertiary roller 134 toward the secondary roller 132 and into contact therewith in the absence of a card. The tertiary roller shaft 162 has an outer end 180 projecting from the feeder body side wall 70 through an oversize opening (not shown) permitting floating movement of the plate 164 in response to the presence of cards of different thicknesses between the secondary and tertiary rollers 132 and 134.

Figure 13:
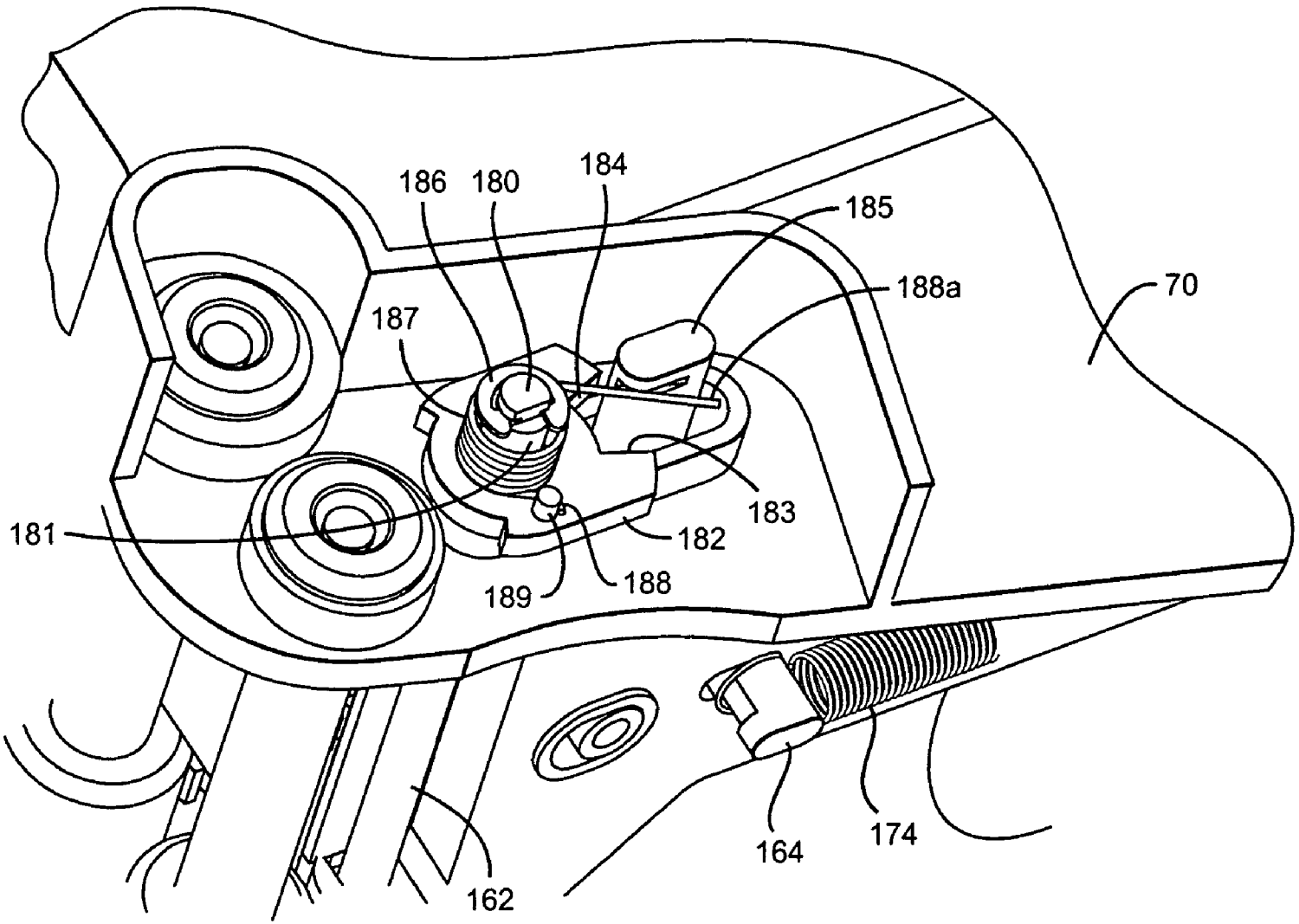
FIG. 13 is a perspective view of a portion of the card feeder showing details of a torsion spring mechanism for biasing a card return roller.

With reference to FIGS. 10-14, and particularly FIG. 13, keyed to the projecting outer end 180 of the tertiary roller shaft 162 is a hub 181 secured to a pivotable plate 182 defining spaced-apart abutment surfaces 183 and 184 positioned to engage a fixed post 185 mounted on the feeder sidewall 70. The plate 182 is retained on the shaft 162 by a snap ring 186. The shaft 162 and the tertiary roller 134 carried thereby are thus able to pivot within the limits imposed by the spacing between the abutment surfaces 183 and 184. Wound around the hub 181 is a torsion spring 187 having an inner end 188 bearing against a pin 189 on the pivotable plate 182 and an outer end 188*a* bearing against the fixed post 185 on the feeder sidewall. The torsion spring 187 thus biases the tertiary roller shaft 162 so that it tends to rotationally pivot clockwise as viewed in FIG. 13. As noted, the extent of the rotational movement of the plate is limited by the spaced-apart abutment surfaces 183 and 184.

Figure 14:
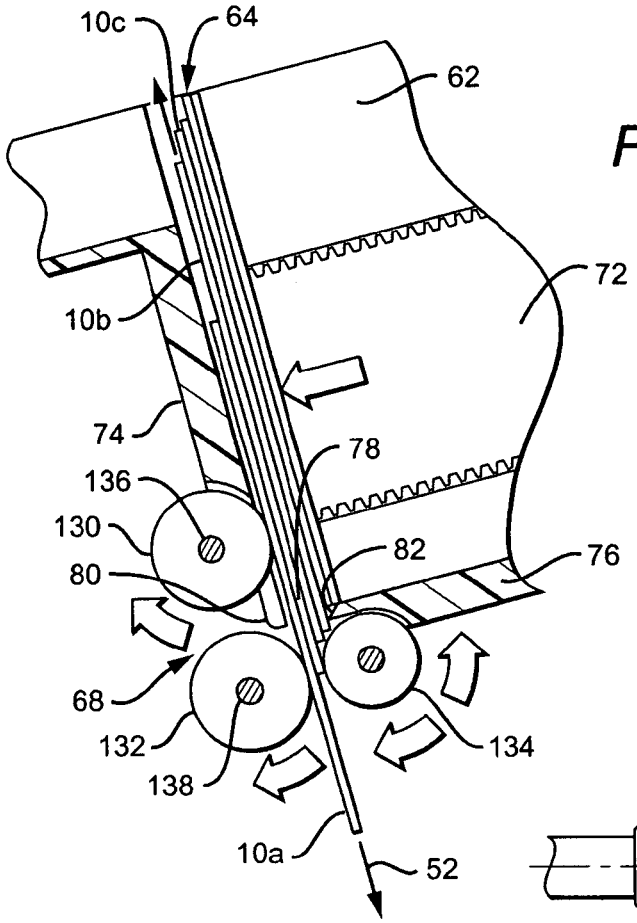
FIG. 14 is a side elevation view, in cross section, of a portion of the card feeder illustrating the operation of the card feed mechanism in preventing double card feeding.

The card feed mechanism 68 prevents the removal of more than one card at a time from the card stack 64. More specifically, when a first, individual card 10*a* passes between the secondary and tertiary rollers 132 and 134 (FIG. 14), a fluctuating pinch is created on the card depending upon the thickness of the card through the spring loaded, floating plate 164 and the tertiary roller 134 carried thereby. With reference to FIG. 14, assume now that a second card 10*b*, clinging to the first card 10*a* because of a static charge, for example, is erroneously withdrawn from the stack along with the first card 10*a*. The torsion spring 187 mounted on the outer end 180 of the tertiary roller shaft 162 winds up in response to the amount of friction between the first and second cards 10*a* and 10*b* versus the amount of friction between the second card 10*b* and the tertiary roller 134. Because the friction between the tertiary roller 134 and the second card 10*b* is greater than the friction between the first and second cards 10*a* and 10*b*, the torsion spring 187 is wound up (to the extent permitted by the limit imposed when the abutment surface 183 engages the post 185) causing the spring 187, when its stored energy is released, to force the second card 10*b* back toward the card stack 64 until the first card 10*a* has exited the zone 160 between the secondary and tertiary rollers.

The primary and secondary rollers 130 and 132 are preferably made of the same material, for example, silicone. The tertiary roller 134 is preferably made of the same material as the primary and secondary rollers but alternatively may be constructed of a different material such as ethylene propylene diene monomer (EPDM). Further, the primary and secondary rollers 130 and 132 preferably have the same outer diameter. Alternatively, the rollers 130 and 132 may have different diameters in which case they are driven at such angular rates that they have the same peripheral velocity.

Figure 15:
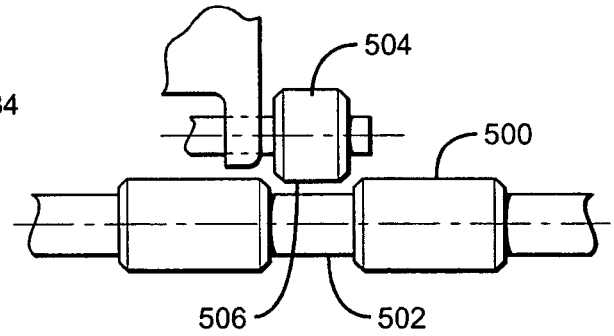
FIG. 15 is a top plan view of a portion a card feeder in accordance with an alternative embodiment of the invention.

Ideally, the secondary and tertiary rollers 132 and 134 are mounted so that a leading card fed by the primary roller 130 is engaged by both the secondary and tertiary rollers. For example, if the thinnest card intended to be processed has a thickness of 0.008 inch, the maximum spacing between the opposed outer surfaces of the secondary and tertiary rollers might ideally be set at 0.007 inch. However, cumulative tolerances in the various parts of the feeder mechanism may preclude precisely setting that spacing. Accordingly, FIG. 15 shows an alternative embodiment in which the need for close tolerances between the secondary and tertiary rollers is avoided. More specifically, FIG. 15 illustrates a secondary roller 500 having a stepped diameter with a smaller diameter portion or circumferential groove 502 in the central part of the roller opposite a tertiary roller 504. The tertiary roller 504 has an outer card-engaging surface 506 that projects slightly into the groove 502 in the secondary roller 500 to introduce a small degree of overlap between the rollers. This arrangement, which does not depend on tight tolerances, always assures contact between a leading card fed from the card feeder and both of the rollers 500 and 504; the slight deflection of the card introduced by this offset arrangement does not affect the operation of the feed mechanism.

Figure 16:
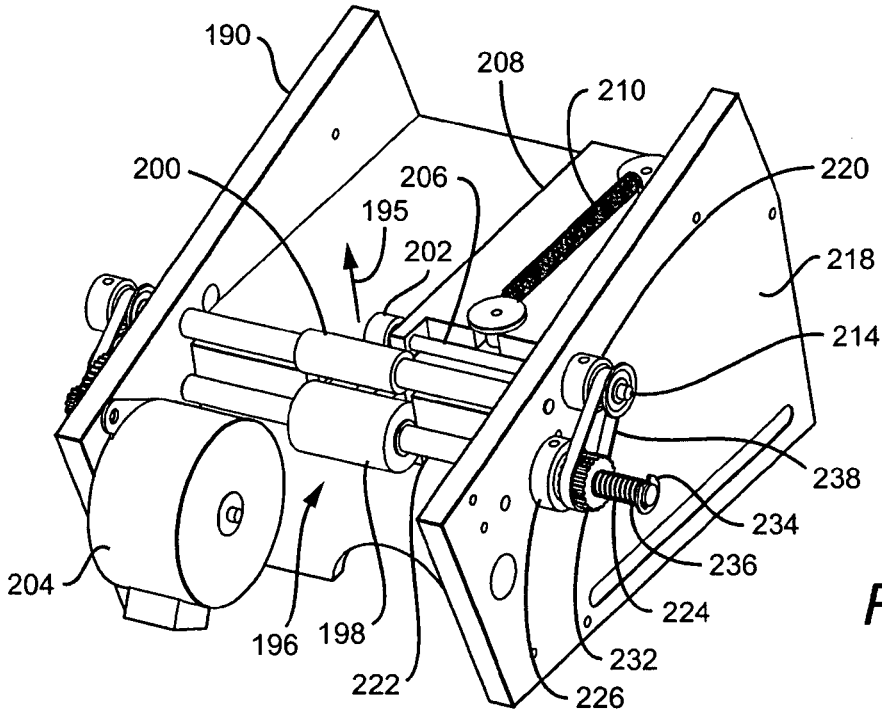
FIG. 16 is a bottom perspective view of a card feeder in accordance with another alternative embodiment of the present invention.

FIGS. 16 and 17 show an alternative embodiment of a card feed mechanism that may be used in the present invention. Like the first embodiment, the alternative embodiment comprises a card feeder body 190 defining a card supply compartment 192 having a fixed discharge opening at the front end thereof through which the cards are advanced along a generally vertical feed path 195. The feeder body 190 supports a card feed mechanism 196 comprising a first or primary friction drive surface 198, a second or secondary friction drive surface 200 and a third or tertiary friction drive surface 202. The drive surfaces 198, 200 and 202 preferably take the form of rollers configured and positioned as previously described. The primary and secondary rollers 198 and 200 are driven by a stepper motor 204 also as already described. The tertiary roller 202, as before, is carried by a shaft 206 journaled for rotation in a floating plate 208 resiliently biased by a tension spring 210 to urge the tertiary roller 202 toward the secondary roller 200 and into contact therewith when no card is present and into engagement with the back face of a card advanced along the feed path 195.

An outer end 214 of the tertiary roller shaft 206 projects through an oversize opening 216 in a sidewall 218 of the card feeder body. As in the first embodiment, the opening 216 is larger than the diameter of the tertiary roller shaft 206 to allow the floating plate 208 to be displaced in response to the presence of cards of various thicknesses transported along the feed path 195 between the secondary and tertiary rollers. Fixed to the outer, projecting end of the tertiary roller shaft 206 is a timing belt sprocket 220.

A shaft 222 that supports and drives the primary card feed roller 198 has an outer end 224 projecting from the side wall 218. Mounted on the outer end of the shaft 222 adjacent to the side wall 218 is a collar 226 secured to the shaft so that the collar rotates with the shaft. Disposed adjacent to the outer surface of the collar is a clutch 228 including a fiber washer 230 that functions as a clutch disk. Adjacent to the fiber washer 230 is a sprocket 232 that is free to rotate on the primary feed roller shaft 222. Disposed between a retainer washer 234 on the outer extremity of the shaft 222 and the outer face of the sprocket 232 is a compression spring 236 that urges the sprocket 232 into frictional engagement with the fiber washer 230. A timing belt 238 couples the sprocket 232 on the shaft 222 and the sprocket 220 secured to the tertiary roller shaft 206. It will be seen that the single stepper motor 204 drives all three rollers 198, 200 and 202 in the same rotational direction. As a result, while the primary and secondary rollers 198 and 200 tend to advance a card along the feed path 195, the tertiary roller 202, being positioned on the side of the feed path 195 opposite that of the primary and secondary feed rollers tends to move the card back toward the card stack. Given the smaller contact area between the tertiary roller 202 and the card and the fact that both the primary and secondary feed rollers urge the card forward along the feed path 195, the action of the tertiary roller 202 is insufficient to drive a single card back toward the card stack. If a second card is erroneously withdrawn along with the first card, however, the frictional force between the tertiary roller 202 and the second card exceeds the frictional force between the two cards; the latter force tends to be substantially less given the slickness of the abutting card surfaces so that the second card will be driven back toward the card stack by the counteracting tertiary roller 202.

When no card is present between the secondary and tertiary rollers 200 and 202, the tertiary roller is driven by the secondary roller in the opposite rotational direction thereto, the friction between these rollers being sufficient to effect such drive and to cause the clutch 228, which tends to drive the tertiary roller in the same direction as the primary and secondary rollers, to slip.

When a single card is advanced through the card discharge opening into the zone between the secondary and tertiary rollers 200 and 202, the tertiary roller, driven through the clutch 228 in a direction opposite to the forward card feed direction, slips on the back surface of the single card, which is driven forward by the higher drive force exerted by the wider primary and secondary rollers 200 and 202.

However, when a second (unwanted) card is drawn out of the card stack along with the first card, the tertiary roller 202, acting on the back surface of the second card at the leading edge thereof, tends to drive the second card back toward the card stack. Such backward or tertiary drive is effected through the clutch 228 because the friction between the tertiary roller and the second card is greater than the friction between the two cards. In this operation, all three rollers 198, 200 and 202 rotate in the same direction.

In summary, the stepper motor 204, acting through the clutch 228, at all times tends to rotate the tertiary roller 202 in the same direction as the primary and secondary rollers 198 and 200. This tendency is overcome, and the clutch 228 slips, when no card or one card is present in the pinch zone between the secondary and tertiary rollers. It is only when a second card is erroneously withdrawn from the card stack along with a first card, that the tertiary roller rotates in a direction forcing the second card back into the card stack.

With reference now to FIGS. 18-21, there are shown alternative embodiments of the card feed mechanisms 68 and 196 described above for feeding cards 10*a*, 10*b*, and so forth, one at a time along a generally vertical first feed path 250. The embodiment of FIG. 18 comprises a card feed mechanism 252 including a primary frictional drive surface in the form of an endless belt 254 trained about rotatable drums 256 and 258, and a secondary frictional drive surface in the form of a roller 260. The embodiment of FIG. 19 comprises a card feed mechanism 262 including a primary frictional drive surface in the form of a roller 264 and a secondary frictional drive surface in the form of an endless belt 266. In the embodiment of FIG. 20, a card feed mechanism 268 is provided comprising primary and secondary frictional drive surfaces defined by endless belts 270 and 272, while in the embodiment of FIG. 21, a card feed mechanism 274 combines both the primary and secondary frictional drive surfaces into a single endless belt 276.

Card Re-Director or Rotator

Figure 29:
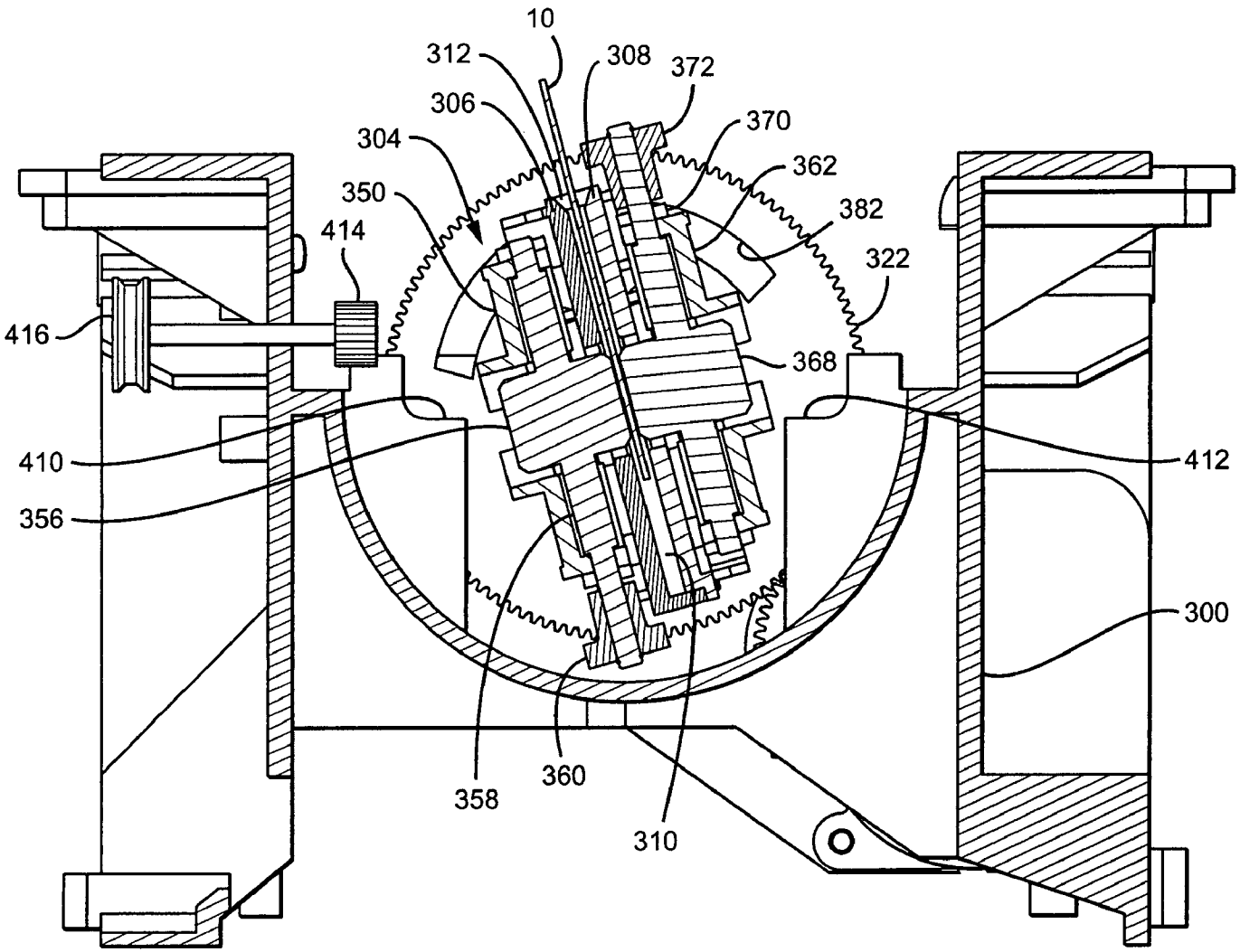
FIG. 29 is a transverse cross section view of a portion of the card rotator and its frame.
Figure 30:
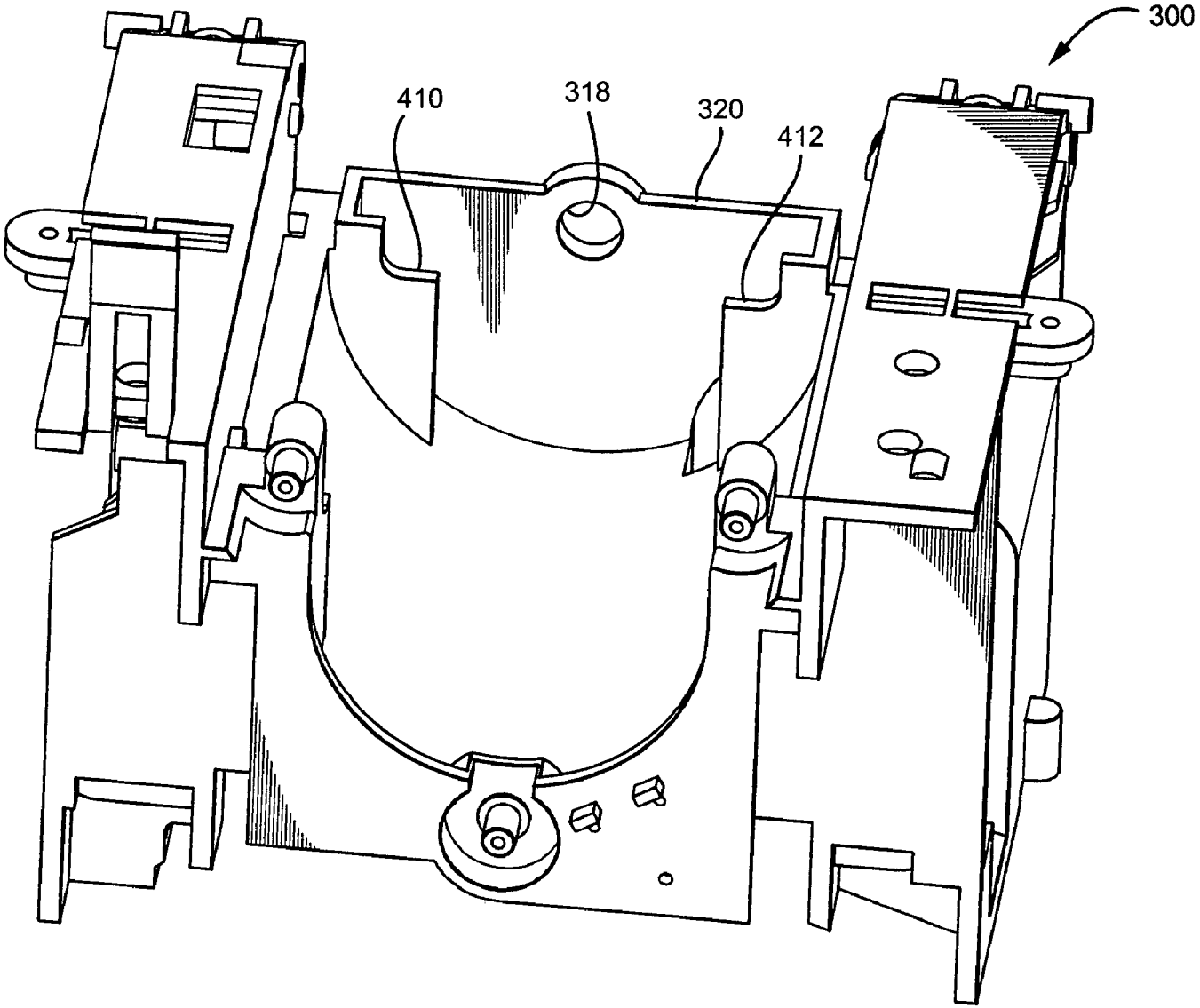
FIG. 30 is a perspective view of the frame of the card rotator.

With reference to FIGS. 4 and 22-41, the card re-director or rotator 46 is mounted on a frame or base 300 for rotation about a central, horizontal axis 302. The rotator comprises a card receiving, holding and ejecting subassembly 304 comprising a pair of parallel, spaced-apart plates 306 and 308 defining between them a card throat 310 having an elongated card input opening or slot 312 extending parallel with the central axis 302. The card throat 310 receives each of the cards 10 fed from the card feeder 44 and holds each card during rotation thereof. The card 10 is held against stops (not shown) within the card throat 310 by gravity. The plate subassembly 304 is supported at one end by a disk 314 and at the other end by a stub shaft 316 journaled for rotation in an aperture 318 in an end wall 320 of the base 300 (FIG. 30). The stub shaft 316 projects from the end wall 320 and carries a large, rotator drive gear 322 that can rotate relative to the stub shaft 316. The disk 314 and the gear 322 lie in vertical, parallel planes and are centered on, and rotatable about, the central axis 302. The disk 314 defines an elongated, transverse card discharge opening or slot 324 extending along a diameter of the disk in alignment with the card throat 310. As will be explained, cards are transported from the throat through the rotator discharge slot 324 for loading into the card print mechanism 48.

The plate subassembly 304 is rotatably supported at its one end by the disk 314 which has a periphery 326 engaging three equiangularly spaced, flanged disk support wheels 328, 330 and 332 mounted for rotation on a side member 334 of the rotator base 300. The end gear 322 is in mesh with a smaller gear 336 in turn driven by the output shaft of a computer controlled stepper motor 337 (FIG. 27). An optical sensor 338 on the rotator base 300 operatively associated with a photo-interrupter 340 on the disk 314 provides electrical output signals responsive to the angular position of the card rotator. The output signals generated by the optical sensor 338 are coupled to a printer controller along with output signals generated by card edge and other detectors (not shown) for coordinating the operation of the various elements of the printer, in a manner well known in the art.

The card throat-defining plate 306 carries an arm 350 pivotally mounted on spaced-apart brackets 352 and 354 secured to the plate 306 adjacent to the disk 314 (FIGS. 28 and 32, for example). The arm 350 supports a card drive roller 356 mounted on a shaft 358 journaled in the arm 350. The shaft 358 has an outer end projecting from the arm 350 and carrying a roller drive gear 360. Similarly, the card throat-defining plate 308 carries an arm 362 pivotally mounted on spaced-apart brackets 364 and 366 attached to the plate 308 adjacent to the support disk 314. The arm 362 supports a card drive roller 368 mounted on a shaft 370 journaled in the arm 362 The shaft 370 has an outer end projecting from the arm 362 and carrying a roller drive gear 372. The first-mentioned roller drive gear 360 projects in a direction opposite that of the second-mentioned roller drive gear 372 (FIG. 29). The arm 350 is resiliently biased to pivot and move toward the plate 306 by means of an extension spring 374; similarly, the arm 362 is resiliently biased to pivot and move toward the plate 308 by means of an extension spring 376. It will thus be seen that the arms 350 and 362 are pivotable symmetrically in clam shell fashion between positions in which the rollers 356 and 368 are spaced apart (FIG. 40) and in which the rollers can come into engagement with a card 10 (FIG. 41).

Figure 22:
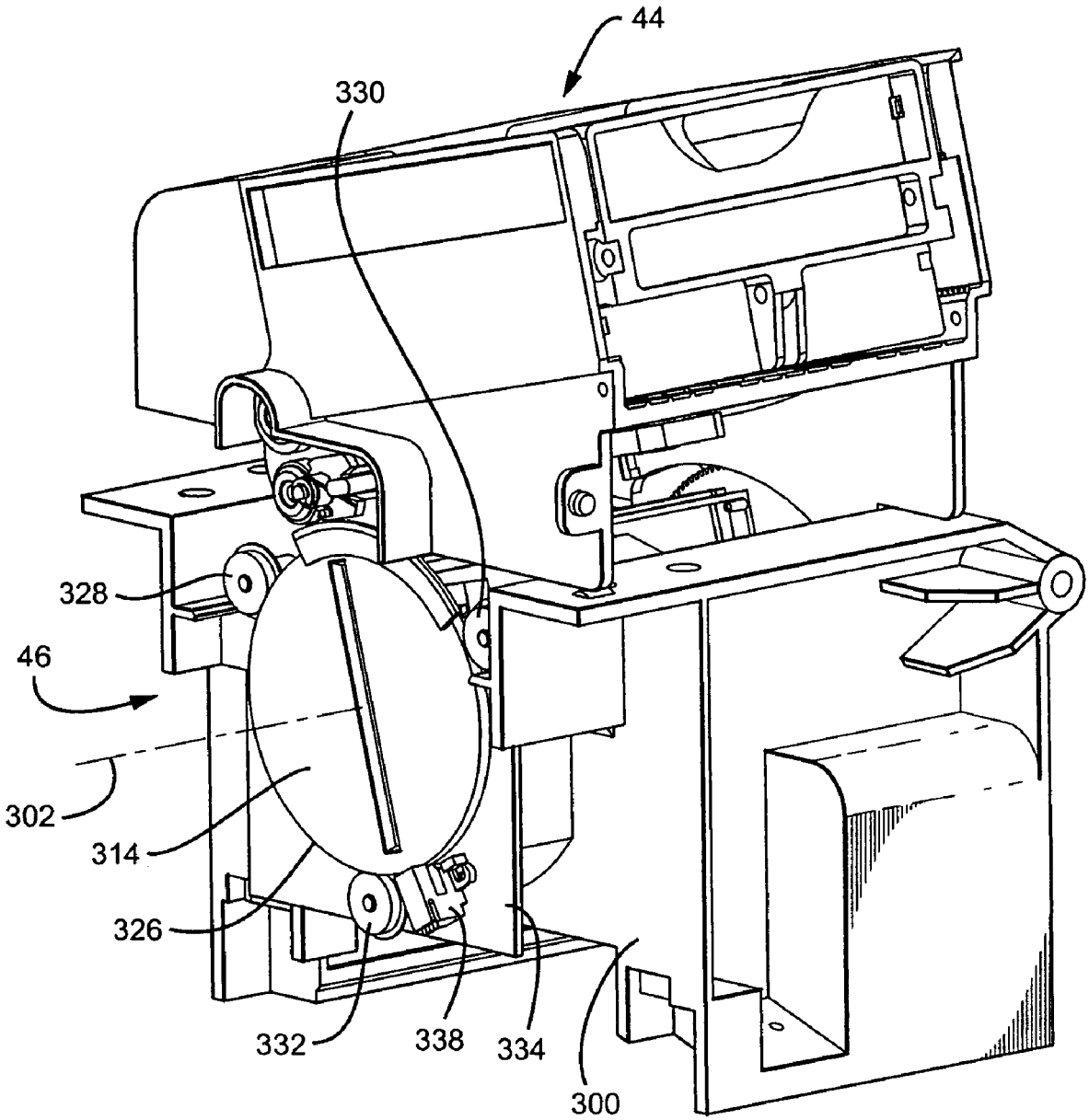
FIG. 22 is a perspective view of a subassembly of the printer shown in FIGS. 2 and 3, the subassembly comprising a card feeder overlying a card re-director or rotator, with the card rotator angularly positioned to receive a card from the card feeder.
Figure 23:
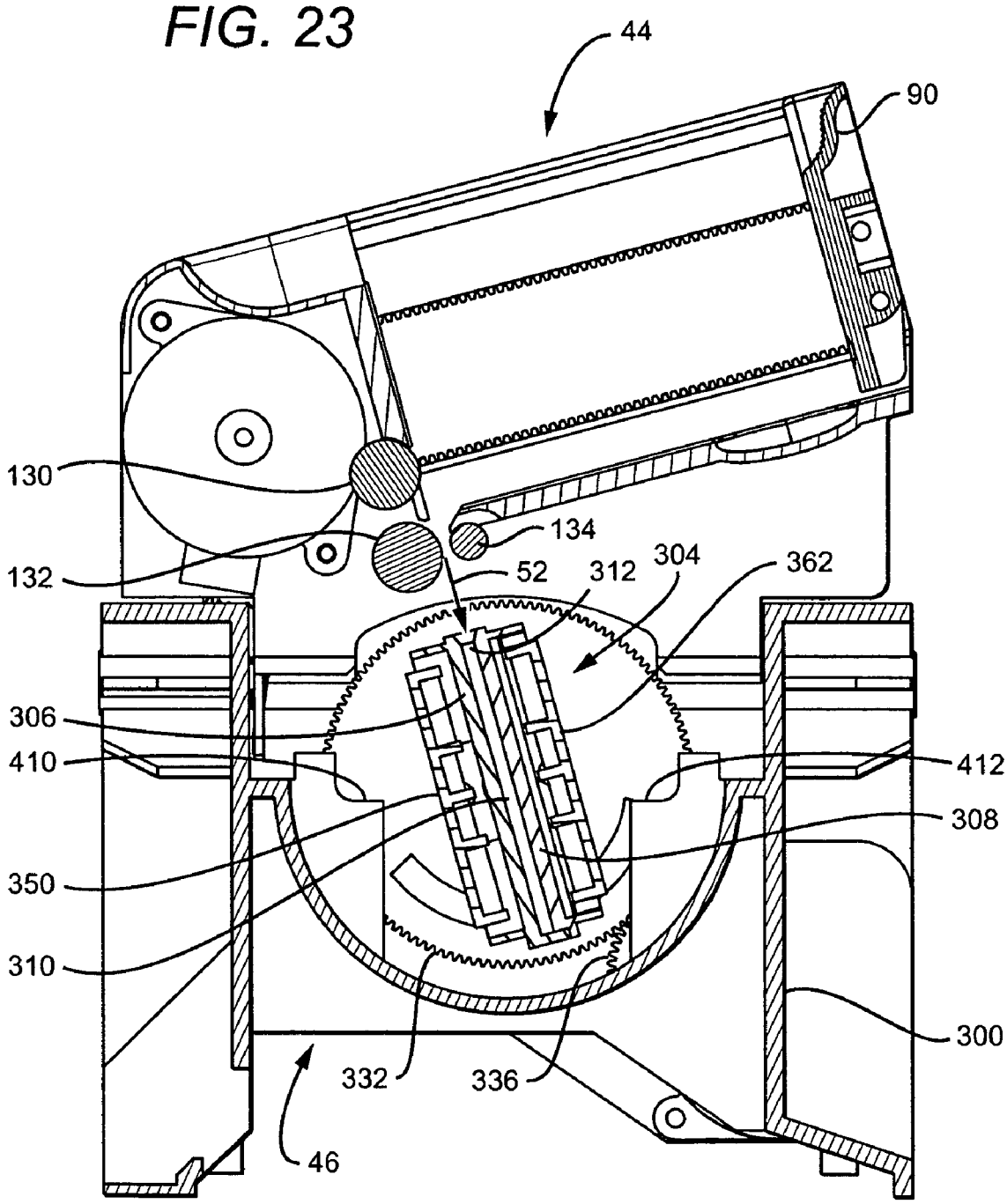
FIG. 23 is an end elevation view, in cross section, of the subassembly shown in FIG. 22.
Figure 24:
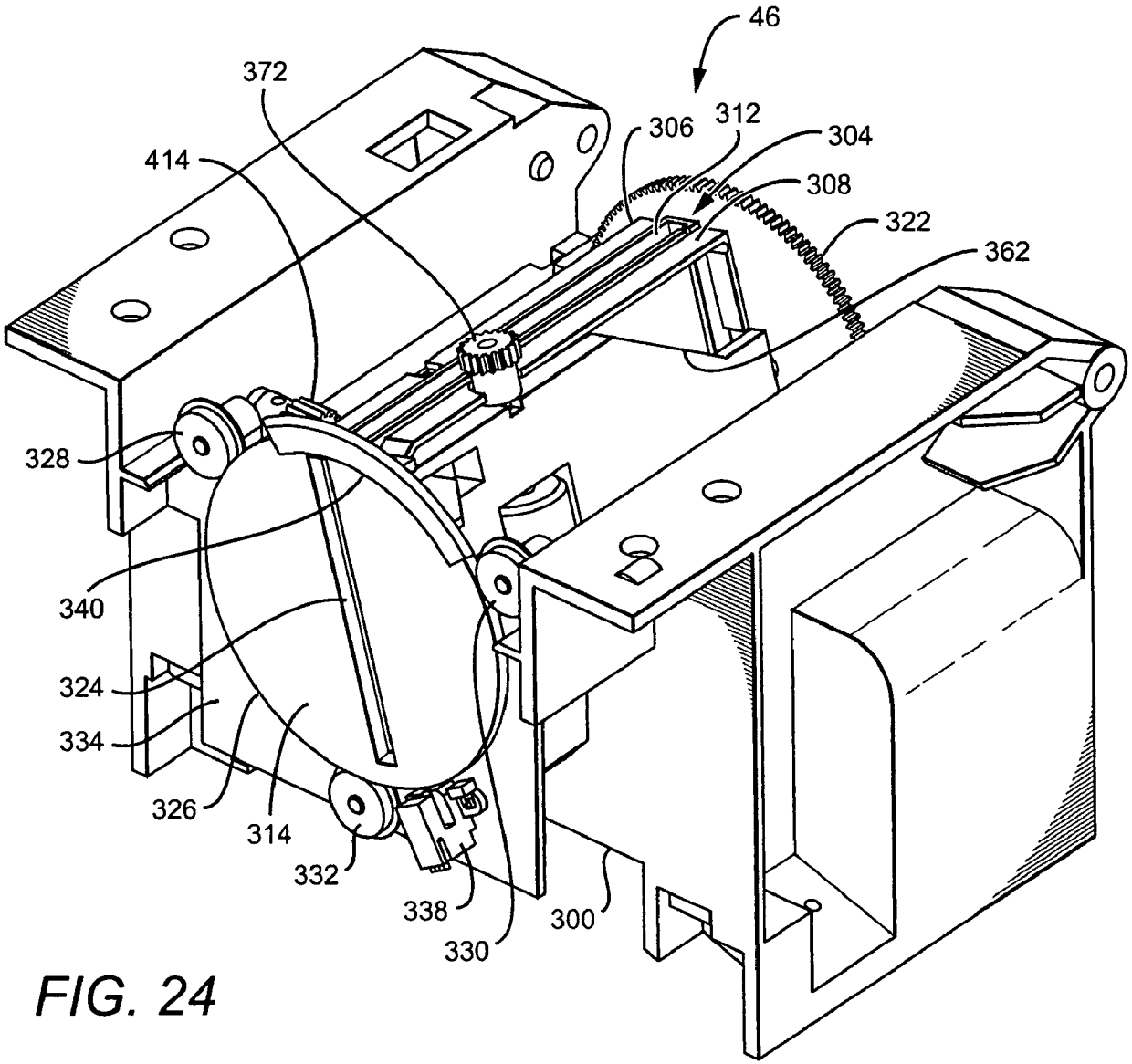
FIG. 24 is a perspective view of the card rotator shown in FIG. 22 with the rotator angularly positioned to receive a card from the card feeder.
Figure 25:
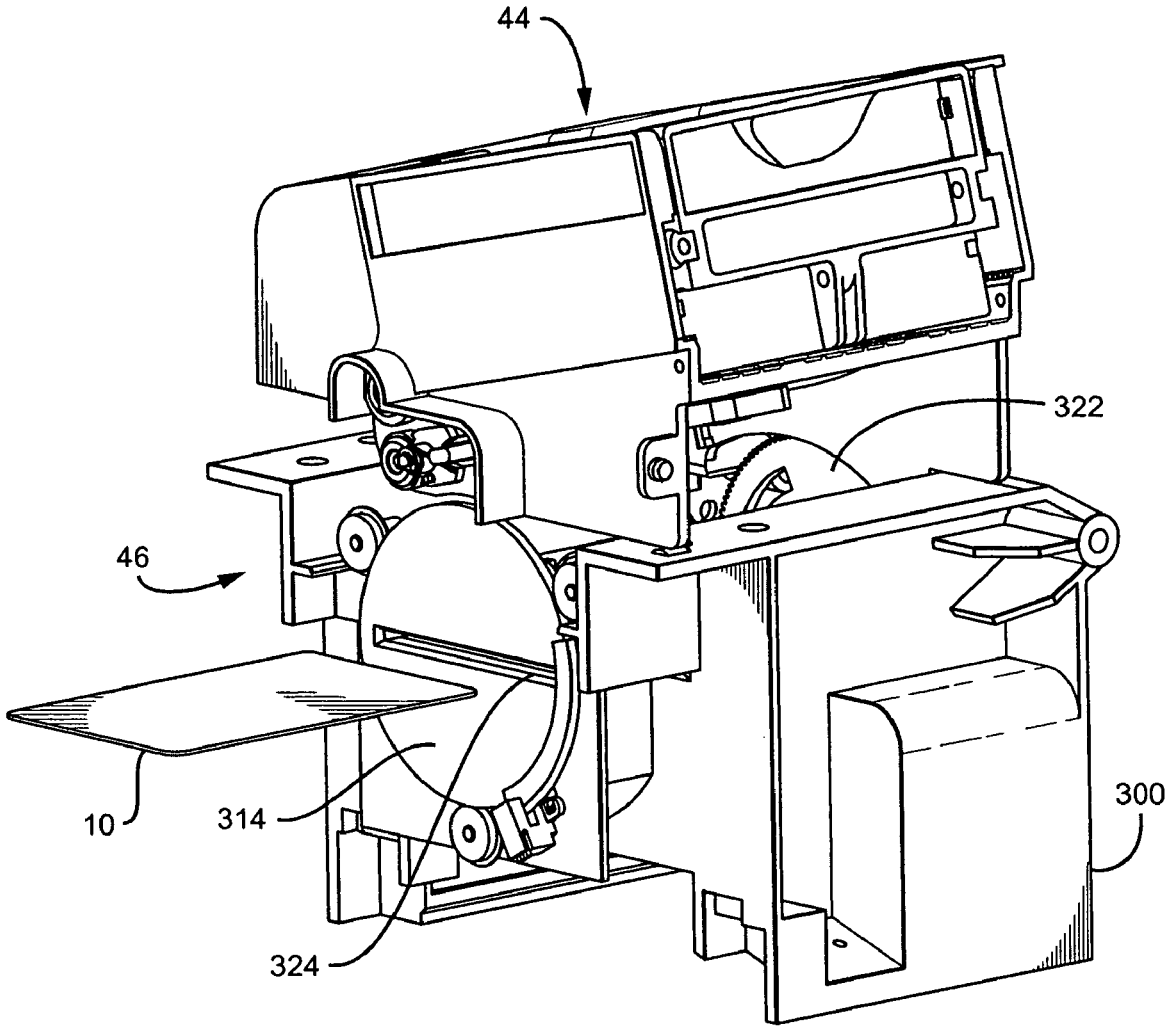
FIG. 25 is a perspective view of the subassembly of FIG. 22, with the card rotator angularly positioned to transfer a card to a print mechanism of the printer.
Figure 26:
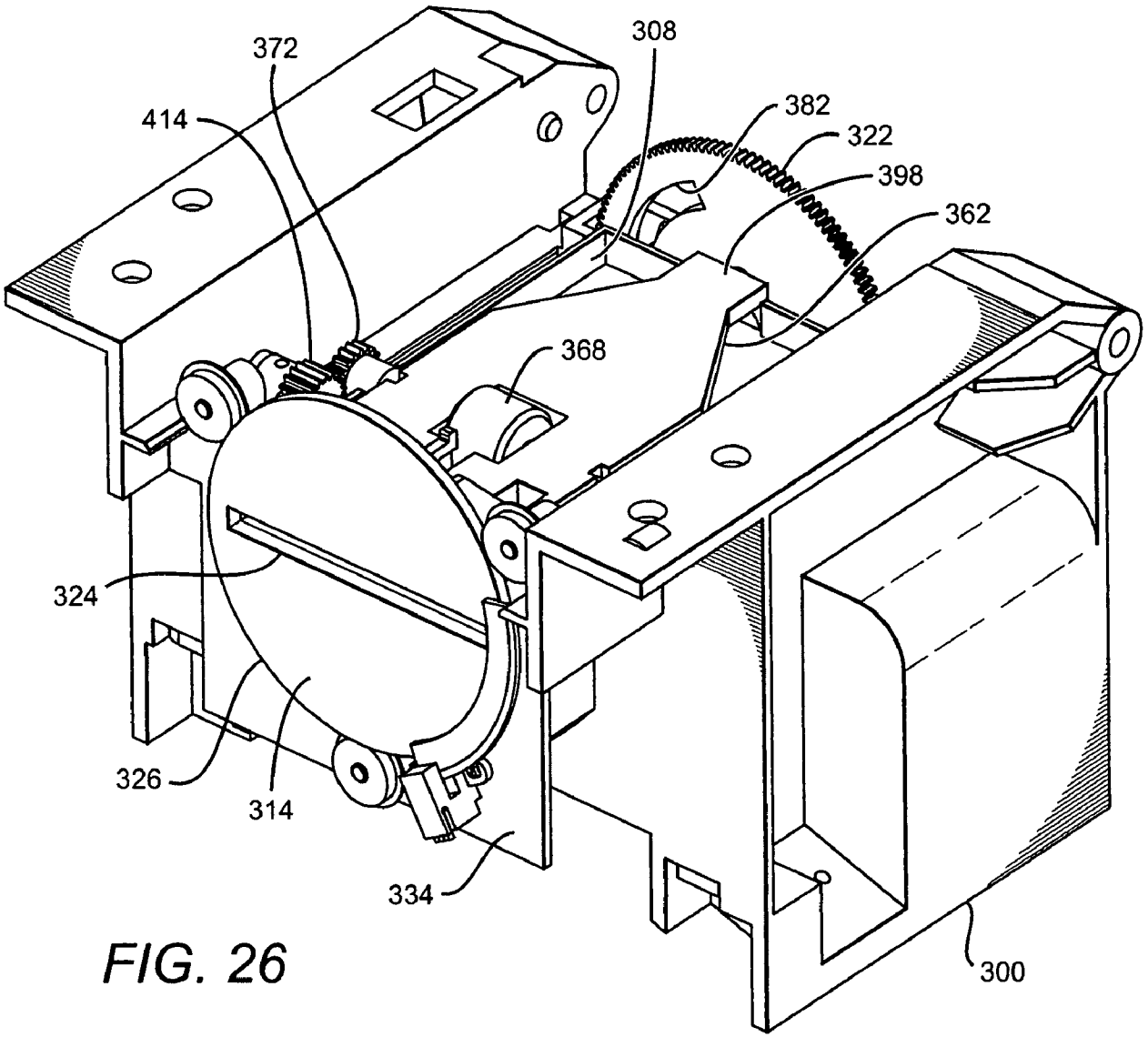
FIG. 26 is a perspective view of the card rotator shown in FIG. 22 with the rotator angularly positioned to transfer a card to the print mechanism of the printer.

Turning now to FIGS. 33-35, the rotator drive gear 322 has a central sleeve 380 that receives the stub shaft 316. The gear 322 further includes an arcuate slot 382 concentric with the axis of rotation 302 (FIG. 22). Projecting outwardly from an outer face 384 of the gear adjacent the inner edge of the arcuate slot 382 at the midpoint thereof is a lug 386. When the gear 322 is mounted on the stub shaft 316, the lug 386 is in alignment with a corresponding lug 388 projecting from the gear end of the throat-defining plate subassembly 304.

Projecting from an inner face 390 of the gear 322 is a pair of cams 392 and 394 disposed symmetrically with the arcuate slot 382 and lug 386. The pivotable arms 350 and 362 include outer ends 396 and 398, respectively, positioned to be engaged by the cams 392 and 394, respectively, so that relative rotational motion between the gear 322 and the subassembly 304 will cause the arms 350 and 362 (and hence the rollers 356 and 368) to be moved apart against the bias of the springs 374 and 376 or toward each other under the bias of the springs.

The central sleeve 380 on the gear 322 carries a torsion spring 400 having crossed ends 402 and 404 engaging the sides of the aligned lugs 386 and 388. The lugs are thereby held in alignment under the torsional bias of the torsion spring 400. Accordingly, rotation of the gear 322 will cause the throat-defining plate subassembly 304 to follow, that is, the gear 322 and the subassembly 304 will rotate in unison. With the lugs 386 and 388 in alignment as shown, for example, in FIG. 38, the cams 392 and 394 on the gear 322 are disposed to lift the arms 350 and 362 to keep the rollers 356 and 368 apart.

Operation

In the operation of the printer, the card re-director or rotator 46 is rotated to an initial position shown in FIGS. 22-24, 27-29, 36 and 40, in which the card throat 310 is in alignment with the first feed path 52. In this position, the throat 310 is disposed to receive a card 10 withdrawn from the card stack 64 and advanced by the card feed mechanism 68 along the first feed path 52. It will be seen that in the specific, exemplary embodiment illustrated the feeder compartment 62 is slightly tipped with the bottom wall 76 of the feeder sloping down toward the front wall 74. This orientation both assists the user's manual loading of the feeder compartment 62 and adds gravity bias to help urge the card stack 64 toward the front wall 74 of the compartment without appreciably increasing the overall height of the printer. The angle is preferably that at which sliding of the card stack 64 impends, for example, about 15° for a given angular coefficient of friction in accordance with one practical embodiment. Although such a tipped orientation is preferred, it will be evident that the compartment 62 may be horizontal so that the orientations of both the cards in the stack and the first feed path 52 are vertical.

As noted, the cards in the stack are preferably oriented with their short edges 22 and 24 substantially vertical, thereby helping to minimize the height of the printer. It will also be appreciated that this card orientation, carried over to the card rotator 46, means that a card will be rotated by the rotator about its major or longitudinal axis 26 instead of around its minor or transverse axis 28 as in conventional printers. Thus, height reduction is achieved by printers of the present invention while at the same time reducing the printer's length by placement of the card feeder 44 above the card rotator 46.

With the rotator 46 positioned rotationally so that the throat 310 is in a substantially vertical position, the arms 350 and 362 are engaged by the cams 392 and 394 and are thus in their spaced-apart orientation. (FIG. 40.) With the rollers 356 and 368 correspondingly spaced apart, a card 10 is fed from the feeder 44 into the throat. The gear 322 is rotated in one direction or the other depending upon which face of the card is to be printed, the gear 322 and the throat subassembly 304 rotating in unison by virtue of the torsion spring 400. (FIGS. 36 and 37.) When the throat subassembly reaches the horizontal position (FIG. 38) further rotation of the subassembly is arrested by one of a pair of stops 410 and 412 on the base (FIGS. 30, 38 and 39).

A sensor is activated at this time by the photo interrupter 340; the output of the sensor turns off the stepper motor driving the gear 322. Once the card throat is aligned with the horizontal plane (FIGS. 25, 26, 38, 39 and 41), the stepper motor is turned on again and by counting a number of steps the motor, through the gear 322, will begin to further rotate the gear 322 against the bias of the torsion spring 400; as noted, the throat subassembly 304 is held by one of the stops 410 and 412 against further movement. As seen in FIG. 39, this further rotation of the gear 322 causes the cams 392 and 394 on the gear 322 to come out of engagement with the arms 350 and 362, allowing these arms to move toward each other under the bias of the extension springs 374 and 376 thereby causing the card feed rollers 356 and 368 to engage the opposed faces of the card 10 in the throat 310 (FIG. 38). As seen in FIGS. 4, 24, 26, 28 and 29, in the horizontal orientation of the throat, one or the other of the roller drive gears 360 and 372 will mesh with a drive pinion 414 carried by the base 300. Actuation of the drive pinion 414 through a belt driven pulley 416 causes the rollers 356 and 368 to rotate and eject the card 10 through the end discharge slot 324 of the rotator and toward the print mechanism 48.

If a card is to have both sides printed, the card is driven back into the card throat 310 along the horizontal path 54 in a reverse direction and back into the rotator 46. The rotator rotates in reverse, moving 180° to flip or invert the card after which the card is driven out of the rotator and printed on the other side. In this operation, the drive pinion 414 will engage the roller drive gear 360 or 372 on the other arm 350 or 362.

Figure 42:
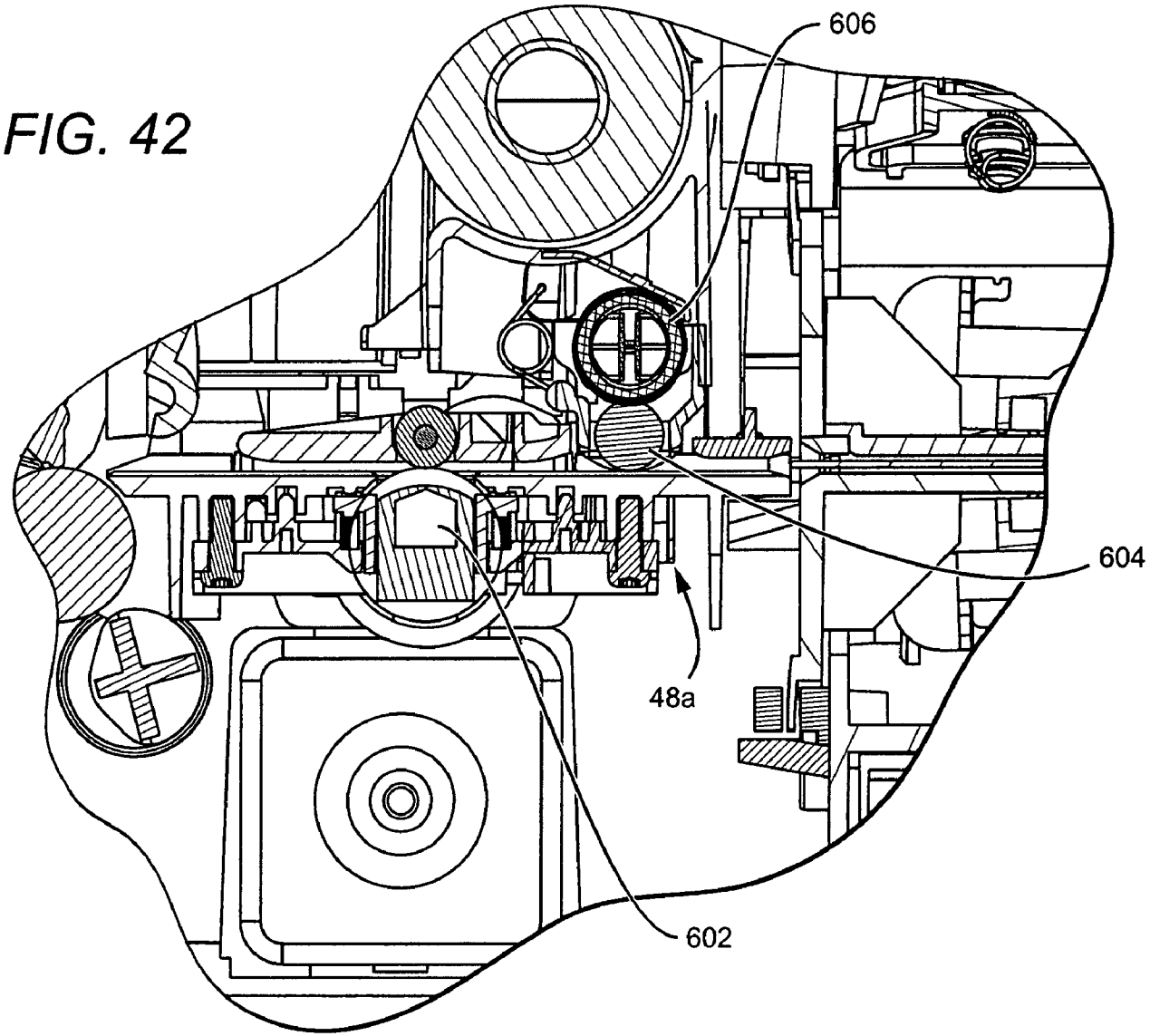
FIG. 42 is a side elevation view, in cross section, of a portion of the printer of FIGS. 3 and 4.

With reference to FIG. 42 and again to FIG. 5, the card printer 40 may also be used to magnetically encode the magnetizable strips on cards processed by the printer. One of the problems encountered during encoding is card "jitter" which tends to degrade the quality of the encoding. Such "jitter" may be caused by the card striking a set of rollers. With reference to FIG. 5, a card drive roller 600 is positioned at a card encoding station along the horizontal feed path 54 between the card cleaning station **48*a* and the printing platen roller 48*d*. The drive roller 600 is a "half" roller, extending only part way across the width of the card feed path 54 so that the roller does not contact the magnetic strip of a card being transported. Mounted adjacent to the roller 600 and in transverse alignment therewith is a magnetic head 602 (FIG. 42) for encoding the magnetic strip as the card is transported past the head by the "half" roller 600**.

The card cleaning station **48*a* comprises the stacked combination of primary "sticky" roller 604 and a secondary "sticky" roller 606. The rollers 604 and 606 are normally resiliently biased downwardly toward the card path 54 but may be selectively moved upwardly away from the path 54** by a cam mechanism (not shown).

In a magnetic encoding operation, a card is driven out of the throat 310 of the card re-director or rotator 46 along the path 54 (to the left as seen in FIG. 5) by means of the drive rollers 356 and 368. The card is further driven to the left by the "half" roller 600 until the card clears the cleaning station **48*a* and the trailing edge of the card is at the roller 600. The cleaning rollers 604 and 606 as well as the rotator drive rollers 356 and 368 are then cammed away from the card path 54. At this point, the card is driven back by the roller 600 towards the throat 310 with the magnetic strip moving past the magnetic head 602. It is during this reverse pass that the card strip is magnetically encoded by the head 602. It will be appreciated that with the rollers 356, 368, 604 and 606 clear of the card path 54** during this encoding operation, the card will not strike any structure that might otherwise cause "jitter" and a possible failure of the encoding process.

As noted, the card rotator 46 is constructed and the card input and discharge slots 312 and 324 are so positioned that a card is oriented for rotation about its short edges to conserve space, but oriented for printing in a direction parallel with its long edges. It would be possible, of course, to eliminate the transverse discharge slot 324 and feed cards both into and out of the slot 312 with the print mechanism appropriately positioned to receive the cards from the slot 312. This means that the application of information to the card face(s) would take place as each card is transported in the direction parallel with the short edges thereof.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

What is claimed is:

1. A vertically compact system adapted for card imaging, card laminating, or other card processing, comprising:

a card processor positioned on a card feed path and configured to process a face of a card;

a card feeder arranged to feed cards onto said feed path upstream of said card processor, said feeder comprising:

a. a compartment for holding a stack of cards; and b. a card feed mechanism configured to successively draw a card from an end of the stack and translate it off the stack;

a card re-director configured to receive the card along a card receiving path, rotate said card about an axis of rotation that is generally perpendicular to said card receiving path, and redirect said card along said card feed path in a direction generally parallel to said axis of rotation.

2. The system of claim 1 wherein:

said card feed path is oriented in a generally horizontal direction;

said compartment is located above said card feed path; and said card feeder feeds cards substantially vertically downward into said card re-director.

3. The system of claim 1 wherein:

the card processor comprises a card printing station.

4. The system of claim 1 wherein:

the card processor comprises a card encoding station.

5. The system of claim 4 wherein:

the card encoding station comprises a magnetic encoding head for encoding a magnetizable strip on said card face.

6. The system of claim 5 wherein:

the card encoding station further comprises a card feed roller for transporting a card past said magnetic encoding head.

7. The system of claim 6 wherein:

said magnetic encoding head and said card feed roller are arranged side-by-side along a direction transverse to the card feed path.

8. The system of claim 1 wherein:

the card processor comprises a card printing station and a card encoding station, the card encoding station being disposed along said card feed path between said card printing station and said card redirector.

9. The system of claim 1 wherein:

said card is a rectangular card defining a major axis and a minor axis;

the cards are stacked with the minor axis oriented generally vertically;

the card redirector comprises a card rotator for rotating the card about its major axis; and the card redirector redirects the card so that the major axis of the card is generally parallel with the card feed path.

10. The system of claim 9 wherein:

said rotator comprises a motor-rotated device having a slot for receiving said card.

11. The system of claim 9 wherein:

said rotator is further configured to receive the card after it has been processed on a first face, to rotate it 180 degrees about its major axis, and to return it to said feed path for transport to said processor.

12. The system of claim 1 including:

a card pusher configured to urge the stack of cards in the direction of said end of the stack.

13. The system of claim 12 wherein:

said card pusher comprises a spring-biased wall at the other end of said stack coupled to an arrangement comprising at least one pinion and at least one rack.

14. The system of claim 13 wherein:

the spring bias on said wall is provided by a torsion spring engaging said at least one pinion.

15. The system of claim 14 including:

a rack and an associated pinion on opposed sides of said compartment, each pinion being coupled to a torsion spring.

16. A printer including a print mechanism for printing on at least one face of each of a plurality of cards each having a pair of opposed, parallel faces, the printer comprising:

a card feeder for holding said plurality of cards and for feeding said cards in succession along a first feed path to a card re-director, wherein the card re-director is adapted to re-direct each of said cards by successively rotating each card about an axis of rotation generally perpendicular to said first feed path and feed each card to said print mechanism along a second feed path that is generally parallel to said axis of rotation.

17. The printer of claim 16 wherein:

said first feed path is generally vertical.

18. The printer of claim 16 wherein:

said second feed path is generally horizontal.

19. The printer of claim 16 wherein:

the card feeder is adapted to hold said plurality of cards with the faces thereof oriented generally vertically.

20. The printer of claim 16 wherein:

said plurality of cards are rectangular and thereby define opposing long edges and opposing short edges;

the card feeder is adapted to hold said plurality of cards with the short edges thereof oriented parallel with the direction of said first feed path and to feed each card in a long edge leading orientation; and the redirector is adapted to rotate each card along an axis of rotation parallel with the long edges of each card.

21. A printer including a print mechanism for printing on at least one face of each of a plurality of cards each having a pair of opposed, parallel faces, the printer comprising:

a card feeder to hold said plurality of cards and to feed said cards in succession along a first feed path to a card re-director, said card re-director comprising a card rotator having an axis of rotation and including a card inlet opening configured to receive said cards in succession along said first feed path, wherein said first feed path is generally perpendicular to said axis of rotation, and a card discharge opening configured to discharge said cards in succession along a second feed path, wherein said second feed path is generally parallel to said axis of rotation.

22. A method of printing on a card having opposed parallel faces, the method comprising:

moving the card from a first station to a second station along a first feed path;

at said second station, redirecting the card by rotating the card about an axis of rotation that is generally perpendicular to the first feed path and moving the card from the second station to a third station along a second feed path in a direction generally parallel to the axis of rotation; and at said third station, printing one of the faces of the card.

23. The method of claim 22, wherein:

the card is a rectangular card defining a pair of opposed parallel long edges and a pair of opposed parallel short edges, after printing one of the faces of the card, moving the card back to said second station along said second feed path with long edges of the card parallel with the second feed path;

at the second station, inverting said card;

moving said inverted card to said third station along said second feed path with the long edges of the card parallel with the direction of the second path; and printing the other face of the card.

24. The method of claim 22, wherein:

the second feed path is substantially perpendicular to the first feed path.

25. The method of claim 22, wherein:

the first feed path is generally vertical with the second station positioned below said first station; and the second feed path is generally horizontal.

26. The method of claim 25, wherein:

during movement of said card along said first feed path, the faces of said card are oriented generally vertically.

27. The method of claim 25, wherein:

during movement of said card along said second feed path, the faces of said card are oriented generally horizontally.

28. A printer including a print mechanism for printing on at least one face of each of a plurality of cards each having a pair of opposed, parallel faces, the printer comprising:

a card feeder for holding said plurality of cards and for feeding said cards in succession along a first feed path to a card re-director, said card re-director comprises a card rotator having an axis of rotation, the first feed path being perpendicular to said axis of rotation and a second feed path being parallel with said axis of rotation, and being adapted to re-direct each of said cards and feed each card to said print mechanism along said second feed path.

29. The system of claim 1 wherein:

said card is a rectangular card defining a major axis and a minor axis;

the cards are stacked with the major axis oriented generally vertically;

the card redirector comprises a card rotator for rotating the card about its minor axis; and the card redirector redirects the card so that the minor axis of the card is generally parallel with the card feed path.

30. The printer of claim 16 wherein:

said plurality of cards are rectangular and thereby define opposing long edges and opposing short edges;

the card feeder is adapted to hold said plurality of cards with the long edges thereof oriented parallel with the direction of said first feed path and to feed each card in a short edge leading orientation; and the redirector is adapted to rotate each card along an axis of rotation parallel with the short edges of each card.

31. The printer of claim 21 wherein:

said plurality of cards are rectangular and thereby define opposing long edges and opposing short edges;

the card feeder is adapted to hold said plurality of cards with the long edges thereof oriented parallel with the direction of said first feed path and to feed each card in a short edge leading orientation; and the redirector is adapted to rotate each card along an axis of rotation parallel with the short edges of each card.

32. The printer of claim 21 wherein:

said plurality of cards are rectangular and thereby define opposing long edges and opposing short edges;

the card feeder is adapted to hold said plurality of cards with the short edges thereof oriented parallel with the direction of said first feed path and to feed each card in a long edge leading orientation; and the redirector is adapted to rotate each card along an axis of rotation parallel with the long edges of each card.

33. The method of claim 22 wherein:

the card is a rectangular card defining a pair of opposed parallel long edges and a pair of opposed parallel short edges, during movement of the card along the first feed path, the card is in a long edge leading orientation, and during movement of the card along the second feed path, the card is in a short edge leading orientation.

34. The method of claim 22 wherein:

the card is a rectangular card defining a pair of opposed parallel long edges and a pair of opposed parallel short edges, during movement of the card along the first feed path, the card is in a short edge leading orientation, and during movement of the card along the second feed path, the card is in a long edge leading orientation.

35. The printer of claim 28 wherein:

said plurality of cards are rectangular and thereby define opposing long edges and opposing short edges;

the card feeder is adapted to hold said plurality of cards with the short edges thereof oriented parallel with the direction of said first feed path and to feed each card in a long edge leading orientation; and the redirector is adapted to rotate each card along an axis of rotation parallel with the long edges of each card.

36. The printer of claim 28 wherein:

said plurality of cards are rectangular and thereby define opposing long edges and opposing short edges;

the card feeder is adapted to hold said plurality of cards with the long edges thereof oriented parallel with the direction of said first feed path and to feed each card in a short edge leading orientation; and the redirector is adapted to rotate each card along an axis of rotation parallel with the short edges of each card.

* * * * *